US009566589B2

(12) United States Patent
Hurd et al.

(10) Patent No.: US 9,566,589 B2
(45) **Date of Patent: *Feb. 14, 2017**

(54) COLLECTORS

(71) Applicant: Georgia-Pacific Chemicals LLC, Atlanta, GA (US)

(72) Inventors: Phillip W. Hurd, Conyers, GA (US); John B. Hines, Atlanta, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 795 days.

This patent is subject to a terminal disclaimer.

(21) Appl. No.: 13/777,296

(22) Filed: Feb. 26, 2013

(65) Prior Publication Data

US 2013/0168594 A1 Jul. 4, 2013

Related U.S. Application Data

(62) Division of application No. 12/496,122, filed on Jul. 1, 2009, now Pat. No. 8,403,146.

(60) Provisional application No. 61/077,725, filed on Jul. 2, 2008.

(51) Int. Cl.

| | |
|---|---|
| ***B01F 17/34*** | (2006.01) |
| ***B01F 3/04*** | (2006.01) |
| ***B03D 1/008*** | (2006.01) |

(52) U.S. Cl.

CPC ..... *B03D 1/008* (2013.01); *B03D 2201/02* (2013.01); *B03D 2203/06* (2013.01); *B03D 2203/10* (2013.01)

(58) Field of Classification Search

CPC . B03D 1/008; B03D 2203/10; B03D 2203/06; B03D 2201/02

See application file for complete search history.

(56) References Cited

U.S. PATENT DOCUMENTS

| | | | | |
|---|---|---|---|---|
| 2,025,984 | A * | 12/1935 | Harris | C10G 33/04 252/61 |
| 2,395,639 | A | 2/1946 | Monson et al. | |
| 2,652,150 | A | 9/1953 | Weinig | |
| 3,275,141 | A | 9/1966 | Adams et al. | |
| 3,425,549 | A * | 2/1969 | Dickson | B03D 1/016 209/166 |
| 4,301,003 | A | 11/1981 | Hseih | |
| 4,585,550 | A | 4/1986 | Avotins et al. | |
| 4,589,980 | A | 5/1986 | Keys | |
| 4,927,669 | A | 5/1990 | Knox et al. | |
| 5,442,082 | A * | 8/1995 | Uphues | C07C 67/31 162/5 |
| 8,133,970 | B2 | 3/2012 | Hurd et al. | |
| 8,403,146 | B2 | 3/2013 | Hurd et al. | |
| 2006/0151360 | A1 | 7/2006 | Wright et al. | |
| 2006/0151397 | A1 | 7/2006 | Wright et al. | |
| 2007/0000839 | A1 | 1/2007 | Wright et al. | |
| 2007/0012630 | A1 | 1/2007 | Wright et al. | |
| 2008/0017552 | A1 | 1/2008 | Wright et al. | |
| 2008/0029460 | A1 | 2/2008 | Wright et al. | |

FOREIGN PATENT DOCUMENTS

| | | | |
|---|---|---|---|
| CN | 1073895 | A | 7/1993 |
| CN | 1343531 | A1 | 4/2002 |
| GB | 584305 | A | 1/1947 |
| GB | 2163975 | A | 3/1986 |
| SU | 666709 | B | 5/1982 |
| WO | 91/16986 | A1 | 11/1991 |

OTHER PUBLICATIONS

S. Panda, Handbook on Oleoresin and Pine Chemicals (Rosin, Terpene Derivatives, Tall Oil, Resin & Dimer Acids), Asia Pacific Business Press Inc., (Oct. 1, 2008), pp. 493-494.*

H. Sis et al, "Reagents used in the flotation of phosphate ores: a critical review", Minerals Engineering 16 (2003) 577-585.*

Georgia-Pacific Chemicals LLC, Material Safety Data Sheet for XTOL® 0530 Rosin Fortified Distilled Tall Oil, effective date Oct. 30, 1997, six pages.

Georgia-Pacific Chemicals LLC, Material Safety Data Sheet for LYTOR® 100 Tall Oil Resin, effective date Jan. 22, 2001, seven pages.

Georgia-Pacific Chemicals LLC, Material Safety Data Sheet for XTOL® 0520 Distilled Tall Oil, effective date Dec. 9, 2004, seven pages.

Georgia-Pacific Chemicals LLC, Material Safety Data Sheet for XTOL® MOTO Modified Tall Oil, effective date May 23, 2007, seven pages.

Georgia-Pacific Chemicals LLC, Material Safety Data Sheet for XTOL® 0542 Rosin Fortified Distilled Tall Oil, effective date Oct. 9, 2007, seven pages.

Georgia-Pacific Chemicals LLC, Material Safety Data Sheet for XTOL® 692 Modified Tall Oil, effective date Oct. 30, 2007, seven pages.

Georgia-Pacific Chemicals LLC, Material Safety Data Sheet for XTOL® 690 Modified Tall Oil, effective date Jan. 23, 2008, seven pages.

Georgia-Pacific Chemicals LLC, Material Safety Data Sheet for XTOL® 304 Tall Oil Fatty Acids, effective date Apr. 4, 2008, six pages.

Georgia-Pacific Chemicals LLC, Material Safety Data Sheet for XTOL® 100 Tall Oil Fatty Acids, effective date Apr. 14, 2008, six pages.

Georgia-Pacific Chemicals LLC, Material Safety Data Sheet for XTOL® 101 Tall Oil Fatty Acids, effective date Apr. 14, 2008, six pages.

Georgia-Pacific Chemicals LLC, Material Safety Data Sheet for XTOL® 300 Tall Oil Fatty Acids, effective date Apr. 14, 2008, six pages.

(Continued)

*Primary Examiner* — Daniel S Metzmaier
(74) *Attorney, Agent, or Firm* — Ram W. Sabnis

(57) ABSTRACT

Collectors for froth flotation including oxidized fatty acid compositions and oxidized and maleated compositions. In particular, use of oxidized tall oil compositions and oxidized and maleated fatty acid compositions are disclosed.

20 Claims, 5 Drawing Sheets

(56) References Cited

OTHER PUBLICATIONS

International Search Report and Written Opinion of the International Search Authority for PCT/US2009/049387, mailed Jan. 22, 2010.

* cited by examiner

COLLECTORS

CROSS-REFERENCE TO RELATED APPLICATION

This application is a Divisional application of co-pending U.S. patent application Ser. No. 12/496,122, filed on Jul. 1, 2009, which claims the benefit of U.S. Provisional Application No. 61/077,725 filed Jul. 2, 2008, each of which is hereby incorporated by reference in its entirety.

TECHNICAL FIELD

This disclosure relates to processing of ore into minerals and gangue. This disclosure also relates to collectors used in froth flotation, and methods of using the collectors in froth flotation.

BACKGROUND

Froth flotation is used for beneficiating ores. In particular, froth flotation can be used for separating valuable minerals in an ore from their associated gangue, or for separating the valuable minerals from one another. Froth flotation involves mixing an aqueous slurry containing finely ground ore particles with a frothing or foaming agent to produce a froth. Ideally, ore particles that contain the desired mineral are preferentially attracted to the froth because of an affinity between the froth and the exposed mineral on the surfaces of the ore particles. The resulting beneficiated minerals are then collected by separating them from the froth.

The ability of a mineral to float is related to its surface properties. Chemical reagents known as "collectors" are used to modify surface properties of minerals, and may be added to the slurry to increase the selectivity and efficiency of the separation process.

Because of the large scale on which mining operations are typically conducted and the large difference in value between the desired mineral and the associated gangue, even relatively small increases in separation efficiency provide substantial gains in productivity.

SUMMARY

This disclosure provides collectors for use in froth flotation, and methods of using the collectors in froth flotation. In some embodiments, the collector comprises an oxidized fatty acid composition. In some embodiments, the collector comprises an oxmal composition, as defined below.

In some embodiments, the method for froth flotation comprises floating a mineral using a collector comprising one or more of an oxidized clean fatty acid composition, an oxmal composition, and mixtures thereof. In some embodiments, the collector can be an oxidized fatty acid composition, such as an oxidized tall oil fatty acid composition. In some embodiments, the collector can be an oxmal composition.

In some embodiments, the method of froth flotation (e.g., phosphate froth flotation) comprises the use of a collector made by the process of: a) providing a clean fatty acid composition; and b) oxidizing the clean fatty acid composition; to separate a mineral from gangue. In some embodiments, the collector can be made by the process of: a) providing a fatty acid composition; b) maleating the fatty acid composition; and c) oxidizing the fatty acid composition.

In some embodiments, the froth flotation process comprises collecting a mineral using an oxidized fatty acid composition, wherein the oxidized fatty acid composition can have one or more of: (1) less than 2.5% by weight of a plant-derived amine; (2) at least 65% by weight of an oxidized fatty acid; (3) less than 5% by weight of a tall oil pitch; or (4) less than 20% by weight of a fuel oil or furnace oil.

In some embodiments, a froth flotation process is provided, the method comprising collecting a mineral using an oxidized fatty acid composition, wherein the oxidized fatty acid composition has an acid value of at least about 80. In some embodiments, the acid value is at least about 110. In some embodiments, the acid value is between about 120 and 150.

Further provided herein are embodiments for a froth flotation process comprising collecting a mineral using an oxidized fatty acid composition or an oxmal composition and providing a yield and/or grade of the mineral which is higher than a yield and/or grade of the mineral provided by a fatty acid composition.

In any of the above embodiments, the collector of any of the above can be an anionic collector. The anionic collector can have a counter cation chosen from for example Li+, Na+, K+, NH4+, alkyl ammonium ions, and imidazoline cations. In any of the above embodiments, the mineral to be floated can be chosen from phosphate, barite, fluorite, feldspar, potash, fluorspar, magnesite, scheelite, celestite, anglesite, alunite, bauxite, gypsum, kainite, biotite, calcite, dolomite, albite, orthoclase, microcline, fluorspar, gypsum, anhydrite, columbite, tantalite, pyrochlore, apatite, cassiterite, wolframite, rutile, ilmenite, hematite, and kaolin. In some embodiments, the mineral is phosphate or potash.

In any of the above methods and embodiments, the method can further comprise the use of one or more of a frothing agent or a depressant.

A method of potash froth flotation is provided, the method comprising floating potash using a collector comprising an oxidized fatty acid composition or an oxmal composition.

Also provided herein is a method of separating a mineral from gangue, the method comprising providing an oxidized fatty acid composition or an oxmal composition to a solution of the mineral and gangue, thereby separating the mineral from the gangue.

A composition is further provided, the composition comprising a collector, wherein the collector comprises one or more of an oxidized fatty acid composition, oxmal composition, and mixtures thereof and one or more of a frothing agent and a depressant. Also provided is a composition comprising two or more collectors, wherein at least one, but not all, of the collectors is an oxidized fatty acid.

Further provided herein is a kit comprising a collector and one or more of a frothing agent and a depressant, wherein the collector comprises one or more of an oxidized fatty acid composition, oxmal composition, and mixtures thereof.

In any of the previous kit embodiments, the kit can further comprises instructions for floating a mineral.

In any of the kit embodiments, the kit can further comprises a label that indicates that the contents are to be used in froth flotation of a mineral.

The details of one or more non-limiting embodiments of the invention are set forth in the accompanying drawings and the description below. Other embodiments of the invention should be apparent to those of ordinary skill in the art after consideration of the present disclosure.

DETAILED DESCRIPTION

I. Definitions

Figure 1:
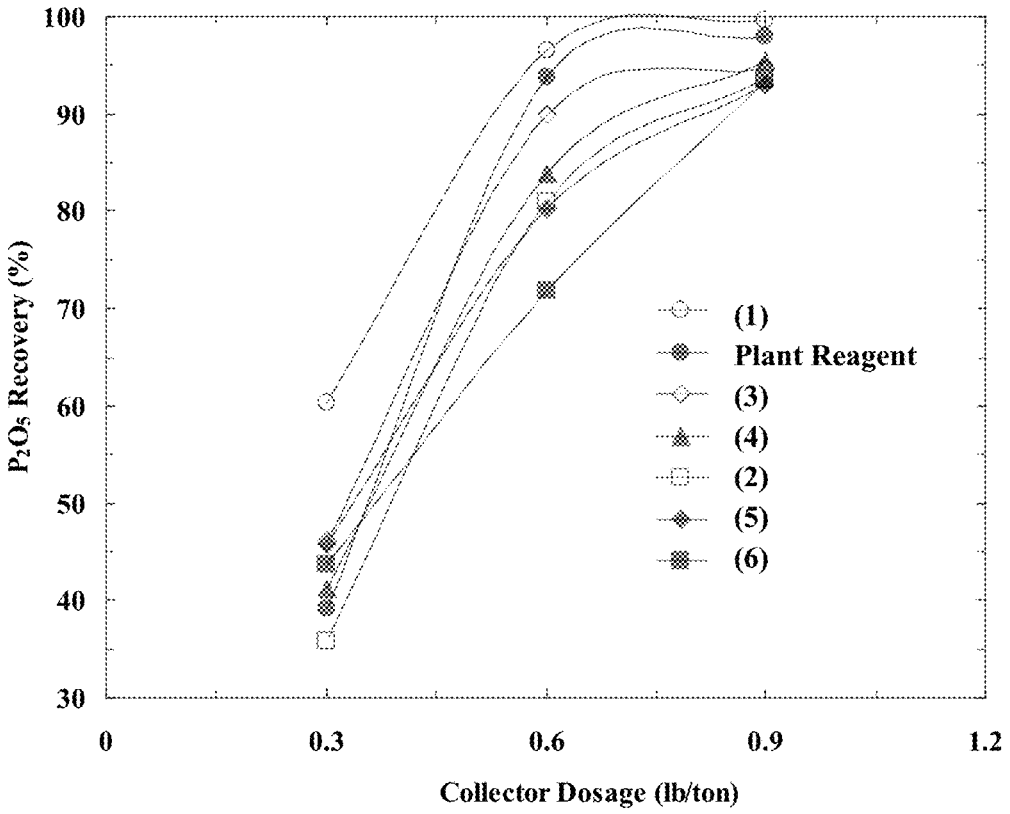
FIG. 1 illustrates the effects of collector type and dosage on phosphate flotation recovery.

Unless defined otherwise, all technical and scientific terms used herein have the same meaning as is commonly understood by one of ordinary skill in the art to which this disclosure belongs. All patents, applications, published applications, and other publications are incorporated by reference in their entirety. In the event that there is a plurality of definitions for a term herein, those in this section prevail unless stated otherwise.

An "oxidized fatty acid" is a compound, or salt thereof, comprising at least two or more fatty acid backbone structures, wherein each backbone structure is linked to one other backbone structure by a bridging group chosen from a direct bond, an ether linkage, or a peroxide linkage located at a non-terminal position of each backbone structure, or is a fatty acid that has been oxidized by any means known in the art.

An "oxidized fatty acid composition" is a composition comprising an oxidized fatty acid, a mixture of two or more oxidized fatty acids, or an oil that has been oxidized by any means known in the art. Non-limiting examples of oxidized fatty acid compositions include tall oils, which have been oxidized; animal oils, which have been oxidized; plant oils, which have been oxidized; algal derived oils, which have been oxidized; and microbially derived oils, which have been oxidized. In some embodiments, oxidized fatty acid compositions can also include one or more non-reacted or partially reacted species, such as non-oxidized fatty acids, rosin acids, and mixtures thereof.

A "clean fatty acid composition" is a composition comprising one or more fatty acids, wherein the composition does not contain one or more of tall oil pitch; an amine (e.g., an amine derived from a plant); and sarcosine. In some embodiments, a clean fatty acid composition also does not contain fuel oil and/or furnace oil.

An "oxidized clean fatty acid composition" is a composition comprising an oxidized fatty acid, a mixture of two or more oxidized fatty acids, or an oil that have been oxidized by any means known in the art, wherein the oxidized clean fatty acid composition does not contain one or more of tall oil pitch; an amine (e.g., a biogenic amine, such as an amine derived from a plant, or a synthetic amine); or sarcosine. In some embodiments, an oxidized clean fatty acid composition also does not contain fuel oil and/or furnace oil. Non-limiting examples of oxidized clean fatty acid compositions include tall oils, which have been oxidized; animal oils, which have been oxidized; plant oils, which have been oxidized; algal derived oils, which have been oxidized; and microbially derived oils, which have been oxidized. In some embodiments, oxidized clean fatty acid compositions can also include one or more non-reacted or partially reacted species, such as non-oxidized clean fatty acids, rosin acids, and mixtures thereof.

An "oxidized and maleated compound" (hereinafter an "oxmal compound") is a compound, or salt thereof, comprising at least two or more hydrocarbon-based backbone structures, wherein at least one of the backbone structures is substituted by at least one of an α,β unsaturated carboxylic acid or anhydride, and further wherein each backbone structure is linked to one other backbone structure by a bridging group chosen from a direct bond, an ether linkage, or a peroxide linkage located at a non-terminal position of each backbone structure. In some embodiments, the hydrocarbon-based backbone structure is a $C_{10}$-$C_{24}$ hydrocarbon. In some embodiments, the hydrocarbon-based backbone is a $C_{10}$-$C_{24}$ fatty acid or rosin acid. In some embodiments, the α,β unsaturated carboxylic acid or anhydride is maleic anhydride, fumaric acid, acrylic acid, or methacrylic acid (herein acrylic acid and methacrylic acid are generally referred to in the aggregate or alternative as (meth)acrylic acid). In some embodiments, the α,β unsaturated carboxylic acid or anhydride is a biogenically derived unsaturated carboxylic acid or anhydride. Non-limiting examples of oxmal compounds include dimers and trimers of fatty acids, rosin acids and mixtures thereof, linked at an intermediary position along the fatty acid or rosin acid backbone by a direct bond, an ether linkage, or a peroxide linkage, and wherein each of the fatty acids and rosin acids is substituted by a maleic anhydride, fumaric acid, or (meth)acrylic acid.

An "oxidized and maleated composition" (hereinafter an "oxmal composition") is a composition comprising one or more oxmal compounds, wherein when the composition comprises more than one oxmal compound, the oxmal compounds can be the same or different. Non-limiting examples of oxmal compositions include tall oils, which have been maleated and oxidized; animal oils, which have been maleated and oxidized; plant oils, which have been maleated and oxidized; algal derived oils, which have been maleated and oxidized; and microbially derived oils, which have been maleated and oxidized. In some embodiments, oxmal compositions can also include one or more non-reacted or partially reacted species, such as non-maleated dimers, trimers, etc of fatty acids, rosin acids, and mixtures thereof.

The phrase "a compound, which has been maleated and oxidized" is used interchangeably with "a maleated and oxidized compound". The phrase "a composition, which has been maleated and oxidized" is used interchangeably with "a maleated and oxidized composition." The phrase "oxidized and maleated" is used interchangeably with "maleated and oxidized."

Wherever the phrase "for example", "such as", and the like are used herein, the phrase "and without limitation" is understood to follow unless explicitly stated otherwise. Therefore, "for example tall oil" means "for example and without limitation tall oil". Similarly all examples herein are non-limiting unless explicitly stated otherwise.

As used herein, the terms "maleated," "maleation," and the like refer to the modification of hydrocarbon-based backbone structures having one or more sites of unsaturation (e.g., $C_{18}$-fatty acids, such as linoleic acid and oleic acid), which introduces additional carboxylic moieties onto the molecules by reaction with one or more α,β unsaturated carboxylic acids or anhydrides. In some embodiments, an α,β unsaturated carboxylic acid or anhydride is chosen from maleic anhydride, fumaric acid, acrylic acid, and methacrylic acid (herein acrylic acid and methacrylic acid are generally referred to in the aggregate or alternative as (meth)acrylic acid). In some embodiments, an α,β unsaturated carboxylic acid or anhydride is a biogenically derived unsaturated carboxylic acid or anhydride.

As used herein, "acid functionality" in addition to its traditional meaning, also encompasses groups which are hydrolyzable such as anhydride groups.

As used herein, the terms "carboxylic moiety" and "carboxylic moieties" are also intended to include the anhydride structure formed by the condensation reaction between two carboxyl groups.

As used herein, "tall oil fatty acid" or "TOFA", consistent with industry standards, encompasses compositions which include not only fatty acids, but also rosin acids and/or unsaponifiables. TOFAs are generally produced as a distillation fraction of crude tall oil and therefore contain saturated and unsaturated fatty acids, rosin acids, and mixtures thereof.

The term "mineral" is used to encompass a pure mineral as well as ore which has been beneficiated.

As used herein, "alkyl," "alkenyl" and "alkynyl" carbon chains, if not specified, should be broadly interpreted, for example to encompass substituted or unsubstituted, straight, branched, and cyclic "chains."

As used herein, "polyolefin oligomers" in addition to its traditional meaning, also encompasses oligomers having one site of unsaturation. As used herein, "about" is meant to account for variations due to experimental error.

II. Methods of Froth Flotation

Provided herein are methods of froth flotation comprising floating a mineral using compounds and compositions, described herein, as froth flotation collectors. In some embodiments, the method comprises floating a mineral using an oxidized fatty acid as a collector in a froth flotation process. In some embodiments, the method comprises floating a mineral using an oxidized fatty acid composition as a collector in a froth flotation process. In some embodiments, the method comprises floating a mineral using an oxidized clean fatty acid composition as a collector in a froth flotation process. In some embodiments, the method comprises floating a mineral using an oxmal compound as a collector in a froth flotation process. In some embodiments, the process comprises floating a mineral using an oxmal composition as a collector in a froth flotation process.

In some embodiments, the method comprises floating a mineral using at least one collector chosen from oxidized fatty acids, oxidized fatty acid compositions, oxidized clean fatty acid compositions; oxmal compounds, oxmal compositions, and mixtures thereof.

In accordance with the invention, collectors as described herein can be used in similar froth flotation applications as fatty acid collectors. For example, the collectors described herein can be used to float phosphate, barite, fluorite, feldspar, potash, fluorspar, magnesite, scheelite, celestite, anglesite, alunite, bauxite, gypsum, kainite, biotite, calcite, dolomite, albite, orthoclase, microcline, fluorspar, gypsum, anhydrite, columbite, tantalite, pyrochlore, apatite, cassiterite, wolframite, rutile, ilmenite, hematite, and kaolin. In some embodiments, the mineral is phosphate or potash. In some embodiments, the mineral is phosphate. In some embodiments, the mineral is potash.

In some embodiments, certain of the collectors, as described herein, exhibit improved performance when compared to fatty acid collectors currently in use. For example, in some embodiments, certain of the collectors exhibit increased yield of a mineral when compared to the fatty acid collectors (e.g., fatty acids derived from tall oil, plant oil, animal oil, or mixtures thereof) currently in use. In some embodiments, certain of the collectors described herein exhibit improved grade of a mineral when compared to the fatty acid collectors currently in use. In some embodiments, less collector is required to float a mineral compared to the fatty acid collectors currently in use.

See, for example, Example 1 which illustrates the ability of an oxidized tall oil fatty acid and an oxmal composition, each in accordance with a certain embodiment of the invention, to increase various aspects of phosphate collection, including percent phosphate flotation recovery, $P_2O_5$ product grade, sols product grade, phosphate separation efficiency, and $P_2O_5$ recovery vs. A.I. rejection when compared to various experimental collectors. In all conditions studied the oxidized fatty acid out performed all other collectors evaluated, including two commercial phosphate collectors. The oxmal composition was found to be superior to a tall oil fatty acid composition (XTOL® 100) which is commonly used as a component of a commercial phosphate collector.

A collector, as described herein, can be used in combination with other compounds, for example, frothing agents, depressants, additional collectors, activators, and modifiers. In some embodiments, a collector, as described herein, can comprise at least about 65% by weight (e.g., at least about 70% by weight, at least about 75% by weight, at least about 80% by weight, at least about 82% by weight, at least about 85% by weight, at least about 94% by weight, at least about 95% by weight, at least about 97% by weight, at least about 98% by weight, at least about 99% by weight, and at least about 99.5% by weight) of a collector composition. In some embodiments, the collector is an oxidized fatty acid compound. In some embodiments, the collector is an oxidized fatty acid composition. In some embodiments, the collector is an oxmal compound. In some embodiments, the collector is an oxmal composition.

A frothing agent can be used to lower the interfacial tension of the aqueous slurry with air and control the size of the air bubbles. These properties can increase the strength and stability of the surface froth, thus improving the ability of the surface froth to support the mineral particles that float until they are removed from the system. Non-limiting examples of frothing agents include pine oil, methyl isobutyl carbinol (MIBC) and other alcohols of similar molecular weight, glycols and polyglycols, glycol and polyglycol ethers of aliphatic alcohols such as cyclohexanol. In some embodiments, a collector is combined with a frothing agent prior to addition to a flotation cell. In some embodiments, a collector and a frothing agent are added individually. In some embodiments, a collector is added to a flotation cell prior to addition of a frothing agent. In some embodiments, a collector is added to a flotation cell following addition of a frothing agent.

A depressant can decrease or prevent the entry of undesired minerals into the froth by precipitating deleterious ions that could interfere with collection or by coating selected minerals to decrease or prevent collector attachment. Non-limiting examples of depressants include urea formaldehyde polymers and oligomers, see, for example, U.S. Patent Publication Nos. 2008/0029460; 2008/0017552; 2007/0012630; 2007/0000839; 2006/0151397; and 2006/0151360. Further examples of depressants include: cyanide salts; sodium sulphide/hydrosulphide; sulphites; waterglass; polysaccharides such as starch, chemically modified polysaccharides like carboxymethylcellulose (CMC); natural gums like guar gum, agar, alginic acid, glucan, carrageenan, chicle gum, gellan gum, glucomannan, gum arabic, locust bean gum, psyllium seed husks, alginates, spruce gum, tara gum, and xanthan gum; and chemically modified natural gums. In some embodiments, a collector is combined with a depressant prior to addition to a flotation cell. In some embodiments, a collector and a depressant are added individually. In some embodiments, a collector is added to a flotation cell prior to addition of a depressant. In some embodiments, a collector is added to a flotation cell following addition of a depressant.

Depending on the ore to be beneficiated and its condition, it can sometimes be desirable to use more than one collector in a froth flotation process. In some embodiments, a collector, as described herein, can be used in combination with one or more additional collectors. Additional collectors can be chosen from, for example, ionic and nonionic collectors. Ionic collectors can be chosen from an anionic collector (e.g., xanthates, thiophosphates, organic sulfides, carboxylic collectors, and sulfoxy collectors), a cationic collector (e.g., amines and amine salts), and an amphoteric collector. Nonionic collectors can include nonpolar and heteropolar collectors. In some embodiments, an additional collector is chosen from amines, fatty acids, fuel oil, kerosene, petroleum sulfonate (e.g., lignin), thionocarbamates (e.g., ethyl isopropyl thionocarbamate and methyl butyl thionocarbamates), xanthates (e.g., isopropyl xanthate, amyl xanthate, butyl xanthate, and ethyl xanthate), tall oil, thiophosphates (e.g., dicresyl thiophosphate, di-sec-butyl thiophosphate, diamyl thiophosphate, and diethyl thiophosphate), oleic acid, xanthogen formate, sodium dodecyl sulfate, and mercaptans (e.g., dodecyl mercaptan). In some embodiments, a collector, as described herein, is combined with at least one additional collector. In some embodiments, a collector is combined with at least two additional collectors. In some embodiments, the combination of collectors are combined prior to addition to a flotation cell. In some embodiments, each collector is added individually to a flotation cell.

Activators can be used to promote coating of the collector onto the desired mineral. In some embodiments, an activator can be an inorganic commodity chemical, such as copper ions (e.g., sulfates and chloride), aluminum salts (e.g., nitrates and sulfates), sodium sulfide, silicates (e.g., sodium and potassium), carbonates (e.g., sodium), hydroxides (e.g., sodium and calcium), lead acetate, and sodium hydrosulfide. In some embodiments, an activator can reduce the amount of collector added to a flotation cell. In some embodiments, an activator can reduce collector consumption. In some embodiments, an activator can increase the preference of a collector for a particular mineral.

A modifier can be used to increase selectivity of a collector. Non-limiting examples of modifiers include: lime, soda ash, alum, ammonia, caustic soda, phosphates, sodium silicate, sulfur dioxide, lignosulfonate, cationic modifiers (e.g., $Ba^{2+}$, $Ca^{2+}$, $Cu^{+}$, $Pb^{2+}$, $Zn^{2+}$, and $Ag^{+}$), anionic modifiers (e.g., $SiO_3^{2-}$, $PO_4^{3-}$, $CN^{-}$, $CO_3^{2-}$, and $S^{2-}$), organic modifiers (e.g., Dextrin, starch, glue, and carboxymethylcellulose), sulfuric acid, and hydrochloric acid. In some embodiments, a modifier can alter the pH of an aqueous slurry. In some embodiments, a modifier can increase the pH of an aqueous slurry. For example, the pH of an aqueous slurry can be increased to a pH ranging from about 9 to about 12. In some embodiments, a modifier can decrease the pH of an aqueous slurry. For example, the pH of an aqueous slurry can be decreased to a pH ranging from about 2 to about 3. In some embodiments, a collector and a modifier are used in combination. In some embodiments, a collector and a modifier are used individually.

In some embodiments, a collector as described herein (e.g., an oxidized fatty acid composition) can be combined with other minor components.

In some embodiments, a collector composition can include less than about 2.5% by weight (e.g., less than about 2% by weight, less than about 1.75% by weight, less than about 1.5% by weight, less than about 1.25% by weight, less than about 1% by weight, less than about 0.75% by weight, less than about 0.5% by weight, less than about 0.25% by weight, less than about 0.1% by weight, and less than about 0.05% by weight) of an amine (e.g., a plant-derived amine).

In some embodiments, a collector composition can include less than about 5% by weight (e.g., less than about 4.5% by weight, less than about 4% by weight, less than about 3% by weight, less than about 2.5% by weight, less than about 2% by weight, less than about 1.75% by weight, less than about 1.5% by weight, less than about 1.35% by weight, less than about 1.25% by weight, less than about 1% by weight, less than about 0.5% by weight, less than about 0.25% by weight, and less than about 1% by weight) of a tall oil pitch.

In some embodiments, a collector composition can include less than about 20% by weight (e.g., less than about 18% by weight, less than about 15% by weight, less than about 12% by weight, less than about 10% by weight, less than about 8% by weight, less than about 6% by weight, less than about 5% by weight, less than about 3% by weight, less than about 2% by weight, less than about 1% by weight, and less than about 0.5% by weight) of a fuel oil (e.g., diesel fuel) or furnace oil.

In some embodiments, a collector may be in a salt form. In some embodiments, a collector is in an anionic form. Any suitable counter cation may be used with an anionic collector, such as $Li^{+}$, K', $Na^{+}$, $NH_4^{+}$, alkyl ammonium ions, and imidazoline cations. In some embodiments, a counter cation can be a divalent or trivalent cation, for example $Mg^{2+}$, $Ca^{2+}$, $Ba^{2+}$, and $Al^{3+}$. In some embodiments, the counter cation is $Na^{+}$. A collector salt, or soap, can be prepared, for example, by reacting the collector (e.g., an oxidized fatty acid composition, an oxidized clean fatty acid composition, or an oxmal composition) with any appropriate base (e.g., NaOH) to prepare the corresponding salt. See, e.g., Examples 8 and 9.

A collector, as described herein, may increase the yield of a mineral when compared to industry standard collectors (e.g., fatty acid collectors). In some embodiments, the yield is increased from about 0.5% to about 50% (e.g., 0.5%, 1%, 1.5%, 1.8%, 2%, 3%, 5%, 7.5%, 10%, 12%, 15%, 20%, 25%, 30%, 40%, and 50%). In some embodiments, the yield is increased 1.8%. In some embodiments, the yield of a mineral using a collector, as described herein, is from about 80% to about 100% (e.g., 80%, 82%, 85%, 87%, 89%, 91%, 93%, 95%, 97%, 97.5%, 98%, 98.5%, 99%, 99.2%, 99.7%, and 99.9%). In some embodiments, the yield of a mineral is 99.7%. See, e.g., Example 1.

In some embodiments, use of a collector as described herein results in improved grade mineral when compared to industry standard collectors. In some embodiments, the percent $P_2O_5$ grade can be improved. In some embodiments, the percent sols product grade can be improved. See, e.g., Example 1.

Depending on the ore and its condition, a collector can be used in an amount ranging from about 0.04 lb per ton of ore to about 10 lb per ton or ore. In some embodiments, a collector can be used in an amount ranging from about 0.3 lb per ton of ore to about 0.9 lb per ton of ore. In some embodiments, a collector can be used in an amount of about 0.9 lb per ton of ore. See, e.g., Example 1.

Any suitable froth flotation cell and method of operation of a froth flotation cell used with fatty acids can be used with a collector as described herein. In some embodiments, the froth flotation is an anionic or positive flotation. In some embodiments, an initial anionic flotation is followed by a cationic or reverse flotation. The non-limiting examples below illustrate various embodiments of a froth flotation process (see Example 1).

In some embodiments, a froth flotation process for beneficiating an ore can include the steps of: (a) forming a slurry comprising water and particles of an ore; (b) intermixing the slurry with a collector as described herein; and (c) collecting the beneficiated ore. In some embodiments, the slurry is an aqueous slurry. In some embodiments, the froth flotation process can further include intermixing the slurry with a frothing agent. In some embodiments, the froth flotation process can further include intermixing the slurry with a depressant. In some embodiments, the frothing agent and/or the depressant are combined with the collector prior to intermixing with the slurry. In some embodiments, the collector, frothing agent, and/or depressant are intermixed with the slurry individually.

In some embodiments, a process of separating particles of a first material from a second material in an aqueous slurry is provided. Such a process can include the steps of (a) adding a collector composition to an aqueous slurry of the materials; (b) providing air bubbles in the aqueous slurry to form bubble-particle aggregates, each of the bubble-particle aggregates having at least one of the air bubbles and at least one of the particles of the first material; and (c) allowing the bubble-particle aggregates to float in the aqueous slurry. In some embodiments, the bubble-particle aggregates further include at least one compound of a collector composition. In some embodiments, the slurry is agitated following addition of the collector composition. In some embodiments, the first material is hydrophobic and the second material is hydrophilic. In some embodiments, the collector composition increased the hydrophobicity of one of the materials.

In some embodiments, a process of floating a phosphate mineral is provided. In some embodiments, the phosphate mineral is separated from a mineral mixture. In some embodiments, the phosphate is separated from carbonate (e.g., dolomite). In some embodiments, the phosphate is separated from dolomite, calcite, quartz, and silicates. In some embodiments, the collector used is selective for phosphate. In some embodiments, an ore slurry comprising phosphate is subjected to a desliming step prior to froth flotation. In some embodiments, a collector as described herein can be used to separate phosphate from the slime fraction.

In some embodiments, a method of separating a mineral from gangues is provided, the method comprising providing an oxidized fatty acid composition to a solution of mineral and gangue, and separating the mineral from the gangue. In some embodiments, the oxidized fatty acid composition facilitates the separation of the mineral from the gangue. Without being bound by theory, in some embodiments the oxidized fatty acid composition functions as a collector. In some embodiments, a method of separating a mineral from gangues is provided, the method comprising providing an oxidized clean fatty acid composition to a solution of mineral and gangue, and separating the mineral from the gangue. In some embodiments, the oxidized clean fatty acid composition facilitates the separation of the mineral from the gangue. Without being bound by theory, in some embodiments the oxidized clean fatty acid composition functions as a collector. In some embodiments, a method of separating a mineral from gangues is provided, the method comprising providing an oxmal composition to a solution of mineral and gangue, and separating the mineral from the gangue. In some embodiments, the oxmal composition facilitates the separation of the mineral from the gangue. Without being bound by theory, in some embodiments the oxmal composition functions as a collector.

II. Collector Compounds and Compositions

The disclosure provides oxidized fatty acid compounds, oxidized fatty acid compositions, oxidized clean fatty acid compositions, oxmal compounds, oxmal compositions, and mixtures thereof useful as collectors in froth flotation, for example, useful for floating ore or minerals otherwise floated by fatty acids such as tall oil fatty acids or side streams of the tall oil distillation process.

A. Oxidized Fatty Acid Compounds

Oxidized fatty acid compounds provided herein comprise at least two or more fatty acid backbone structures, wherein each backbone structure is linked to one other backbone structure by a bridging group chosen from a direct bond, an ether linkage, or a peroxide linkage located at a non-terminal position of each fatty acid backbone structure. The fatty acid backbone structure can be chosen from, for example, $C_{10}$-$C_{22}$ fatty acids. The fatty acid backbone structure can be chosen from, for example, $C_{16}$-$C_{22}$ fatty acids. The fatty acid backbone structure can be chosen from, for example, $C_{16}$-$C_{18}$ fatty acids. The fatty acid backbone structure can be, for example, a $C_{18}$ fatty acid. The fatty acid backbone structure can be chosen from, for example, oleic, linoleic, and linolenic acid.

In some embodiments, the oxidized fatty acid compounds have two or three fatty acid backbone structures, and each of the fatty acid backbone structures is the same. For example, without limitation, each of the two or three fatty acid backbone structures can be an oleic acid. Formulas 1-4 below are examples of oxidized fatty acid compounds having backbone structures chosen from the same fatty acid. Non-limiting examples of oxidized fatty acid compounds having two fatty acid backbone structures that are the same include: oxidized decenoic acid; oxidized dodecenoic acid; oxidized cis-9-tetradecenoic acid; oxidized cis-9-hexadecenoic acid; oxidized oleic acid; oxidized linoleic acid; oxidized linolenic acid; oxidized cis-6,cis-9,cis-12,cis-15-octadecatetraenoic acid; oxidized ricinoleic acid; oxidized cis-9-eicosenoic acid; oxidized cis-11-eicosenoic acid; oxidized eicosadienoic acid; oxidized eicosatrienoic acid; oxidized arachidonic acid; oxidized eicosapentaenoic acid; oxidized erucic acid; oxidized docosadienoic acid; oxidized 4,8,12,15,19-docosapentaenoic acid; oxidized docosahexaenoic acid; and oxidized tetracosenoic acid.

In some embodiments, the oxidized fatty acid compounds have different fatty acid backbone structures. In some embodiments, the oxidized fatty acid compounds have two different fatty acid backbone structures. In some embodiments, the oxidized fatty acid compounds have three different fatty acid backbone structures. For example, without limitation, one of the fatty acid backbone structures can be oleic acid and one can be linoleic acid. Formula 5 below is one example of an oxidized fatty acid compound having two different fatty acid backbone structures.

In some embodiments, an oxidized fatty acid compound may be in a salt form. For example, all or some portion of an oxidized fatty acid compound in an oxidized fatty acid composition can be in a salt form. In some embodiments, an oxidized fatty acid compound is in an anionic form. Any suitable counter cation may be used with an anionic oxidized fatty acid compound, such as $Li^+$, $K^+$, and $Na^+$. In some embodiments, the counter cation is $Na^+$. See Example 8.

Non-limiting specific structure examples of oxidized fatty acid compounds in accordance with the invention are illustrated as Formulas (I)-(V) below. These examples illustrate one isomeric form; other isomers (e.g., cis and trans isomers) can be prepared and accordingly are within the scope of the invention.

(I)

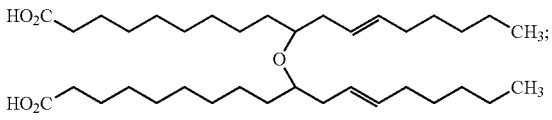

(II)

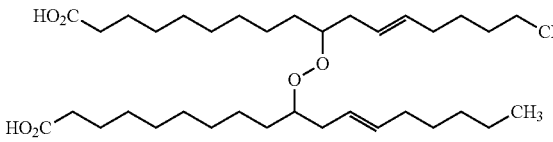

(III)

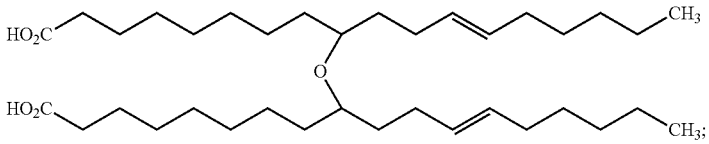

(IV)

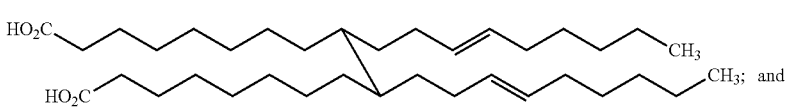

(V)

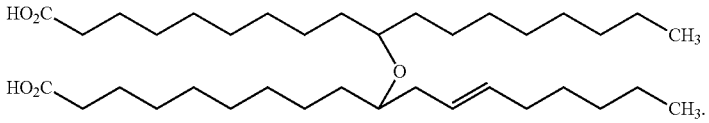

B. Oxmal Compounds

Oxmal compounds provided herein comprise at least two or more hydrocarbon-based backbone structures, wherein at least one backbone structure is substituted by at least one α,β unsaturated carboxylic acid or anhydride, and further wherein each backbone structure is linked to one other backbone structure by a bridging group chosen from a direct bond, an ether linkage, or a peroxide linkage located at a non-terminal position of each backbone structure.

The hydrocarbon backbone structure can be chosen from, for example, substituted and unsubstituted straight-chain, branched-chain and polycyclic hydrocarbons. The hydrocarbon backbone structure can be chosen, for example, from fatty acids and rosin acids. The hydrocarbon backbone structure can be chosen from, for example, $C_{10}$-$C_{22}$ fatty acids. The hydrocarbon backbone structure can be chosen from, for example, $C_{16}$-$C_{22}$ fatty acids. The hydrocarbon backbone structure can be chosen from, for example, $C_{16}$-$C_{18}$ fatty acids. The hydrocarbon backbone structure can be, for example, a $C_{18}$ fatty acid. The hydrocarbon backbone structure can be chosen from, for example, oleic, linoleic, and linolenic acid.

In some embodiments, the hydrocarbon-backbone structure is chosen from polyolefin oligomers having at least one reactive allylic site. In some embodiments, polyolefin oligomers have at least one site of unsaturation. In some embodiments, polyolefin oligomers have at least two sites of unsaturation. In some embodiments, polyolefin oligomers have at least three sites of unsaturation. In some embodiments, the polyolefin oligomers have from 10 to 24 carbons and at least one site of unsaturation. In some embodiments, polyolefin oligomers have from 10 to 24 carbons and from one to five sites of unsaturation. In some embodiments, polyolefin oligomers have from 10 to 24 carbons and from one to three sites of unsaturation. In some embodiments, the polyolefin oligomers have from 16-18 carbons and from one to three sites of unsaturation. In some embodiments, the polyolefin oligomers have 16 or 18 carbons and two sites of unsaturation. In some embodiments, the hydrocarbon-backbone structure could be chosen from non-natural fatty acids, for example fatty acids having odd chain lengths, or 14 carbon chain lengths. In some embodiments, the hydrocarbon-backbone structures chosen from non-natural fatty acids comprise from 1 to 3 sites of unsaturation, for example 2, or for example 3 sites of unsaturation.

In some embodiments, the α,β unsaturated carboxylic acid or anhydride is a synthetic α,β unsaturated carboxylic acid or anhydride. Non-limiting examples of synthetic α,β unsaturated carboxylic acids or anhydrides include maleic anhydride, fumaric acid, and (meth)acrylic acid. In some embodiments, the α,β unsaturated carboxylic acid or anhydride can be a biogenically derived α,β unsaturated carboxylic acid or anhydride. Non-limiting examples of biogenically derived α,β unsaturated carboxylic acids or anhydrides include itaconic acid, itaconic anhydride, aconitic acid, aconitic anhydride, acrylic acid, methacrylic acid, citraconic acid, citraconic anhydride, itaconic acid, mesaconic acid, muconic acid, glutaconic acid, methylglutaconic acid, traumatic acid, and fumaric acid. The acids and anhydrides include any isomers (e.g., enantiomers, diastereomers, and cis-/trans-isomers), and salts. In some embodiments, the α,β unsaturated carboxylic acid or anhydride can be maleic anhydride, fumaric acid, or (meth)acrylic acid.

In certain embodiments all of the hydrocarbon-based backbone structures of an oxmal compound are maleated. In other embodiments, only some, for example, only one of the hydrocarbon-based backbone structures of an oxmal compound are maleated. In some embodiments, two of the hydrocarbon-based backbone structures of an oxmal compound are maleated. In some embodiments, at least one of the hydrocarbon-based backbone structures of an oxmal compound is maleated.

Oxmal compounds within the scope of the invention include oxidized and maleated unsaturated fatty acid compounds of Formula VI:

$$R'—L—R'—[L—R']_n \quad \text{(VI)}$$

wherein L is chosen from a direct bond, —O—, or —OO—; n is a number chosen from 0, 1, 2, 3, 4, and 5; and R' is a compound of Formula VII:

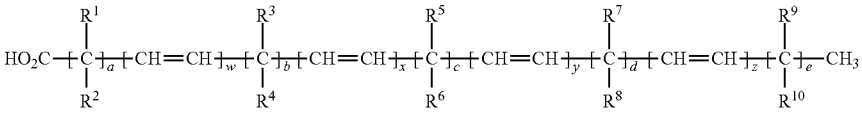

(VII)

wherein a, b, c, d, and e are independently a number from 0 to 20; w, x, y, and z are independently 0 or 1; $R^1$-$R^{10}$ are each independently chosen from L, H, alkyl, alkenyl, alkynyl, alkoxy, amino, hydroxy, and X; wherein at least one of $R^1$-$R^{10}$ is X; and wherein at least one of $R^1$-$R^{10}$ is L; wherein X is an α,β unsaturated carboxylic acid or anhydride; wherein the sum of a, b, c, d, e, w, x, y, and z is a number from 8 to 22; and wherein at least one of w, x, y, and z is 1. In some embodiments, the sum of a, b, c, d, e, w, x, y, and z is a number from 12 to 18, while in other embodiments, the sum of a, b, c, d, e, w, x, y, and z is 16. In some embodiments, X is chosen from maleic anhydride, fumaric acid, and (meth)acrylic acid. In some embodiments, X is chosen from

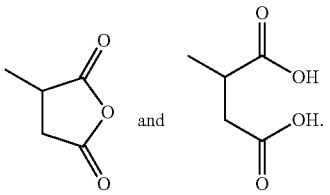

In some embodiments, n is 0 or 1. In some embodiments each R' does not require a substitution with X to be present as long as at least one of R' in the compound of Formula VI does contain at least one X.

In some embodiments, the oxmal compounds have two or three hydrocarbon-based backbone structures (for example, two or three R' structures of Formula VII), and each of the hydrocarbon-based backbone structures is of the same type. For example, without limitation, each of the two or three hydrocarbon-based backbone structures can be a fatty acid. In some embodiments, the oxmal compounds comprise two or three hydrocarbon-based backbone structures, wherein each of the hydrocarbon-based backbone structures is the same. Formulas 8-10, 14-16, 20-22, 29, and 30 below are examples of oxmal compounds having backbone structures chosen from the same fatty acid. Non-limiting examples of oxidized and maleated fatty acids having two hydrocarbon-based backbone structures that are the same include: oxidized and maleated decenoic acid; oxidized and maleated dodecenoic acid; oxidized and maleated cis-9-tetradecenoic acid; oxidized and maleated cis-9-hexadecenoic acid; oxidized and maleated oleic acid; oxidized and maleated linoleic acid; oxidized and maleated linolenic acid; oxidized and maleated cis-6,cis-9,cis-12,cis-15-octadecatetraenoic acid; oxidized and maleated ricinoleic acid; oxidized and maleated cis-9-eicosenoic acid; oxidized and maleated cis-11-eicosenoic acid; oxidized and maleated eicosadienoic acid; oxidized and maleated eicosatrienoic acid; oxidized and maleated arachidonic acid; oxidized and maleated eicosapentaenoic acid; oxidized and maleated erucic acid; oxidized and maleated docosadienoic acid; oxidized and maleated 4,8,12,15,19-docosapentaenoic acid; oxidized and maleated docosahexaenoic acid; and oxidized and maleated tetracosenoic acid.

In some embodiments, the oxmal compounds have two different hydrocarbon-based backbone structures. For example, without limitation, one of the hydrocarbon-based structures can be chosen from fatty acids and one can be chosen from rosin acids. Formulas 11-13, 17-19, and 23-25 below are examples of oxmal compounds having one rosin acid hydrocarbon-based backbone structure and one fatty acid hydrocarbon-based backbone structure. As another non-limiting example, the hydrocarbon backbone-structures can be two different fatty acids. For example, without limitation, one of the hydrocarbon-based backbone structures can be oleic acid and one of the hydrocarbon-based backbone structures can be linoleic acid.

In some embodiments, an oxmal compound may be in a salt form. For example, all or some portion of an oxmal compound in an oxmal composition can be in a salt form. In some embodiments, an oxmal compound is in an anionic form. Any suitable counter cation may be used with an anionic oxmal compound, such as $Li^+$, $K^+$, and $Na^+$. In some embodiments, the counter cation is $Na^+$. See Example 9.

Non-limiting specific structure examples of oxmal compounds in accordance with the invention are illustrated as Formulas 8-32 below. These examples illustrate one isomeric form; other isomers (e.g., cis and trans isomers) can be prepared and accordingly are within the scope of the invention.

(VIII)
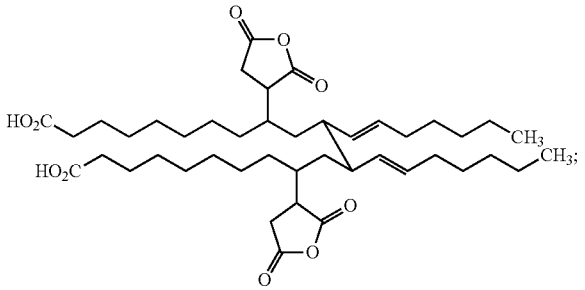
(IX)
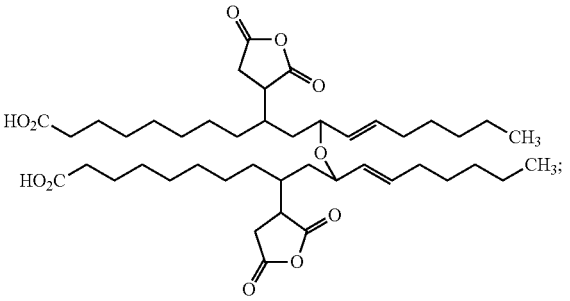
(X)
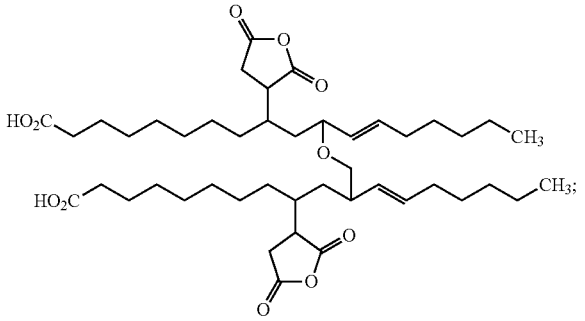
(XI)
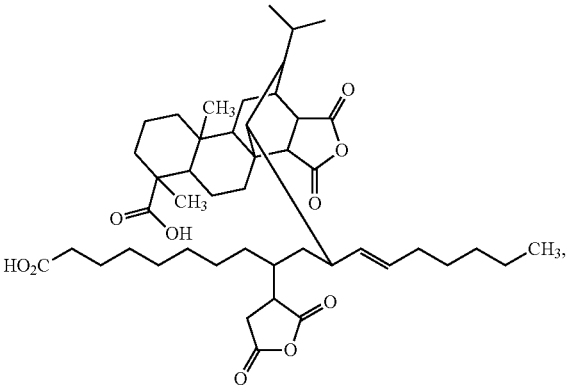
(XII)
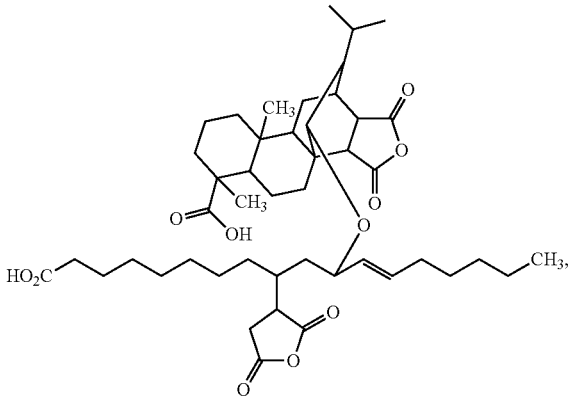
(XIII)
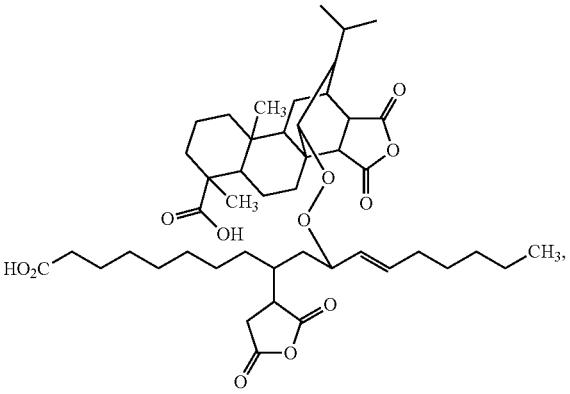
(XIV)
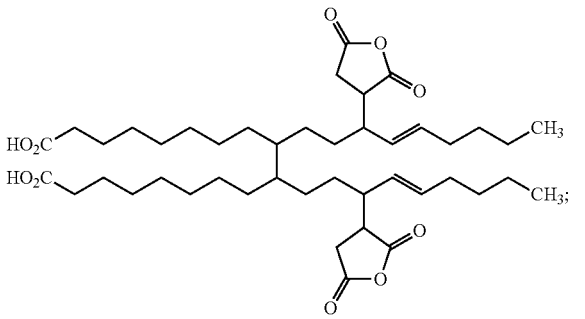
(XV)
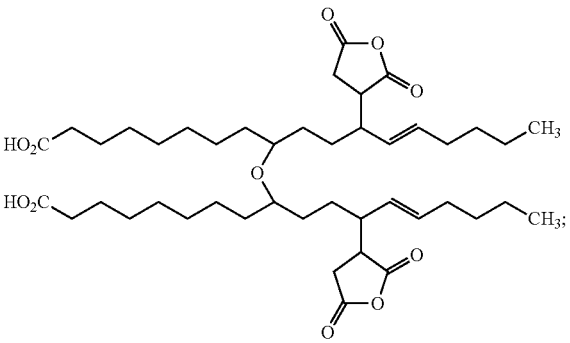

-continued
(XVI)
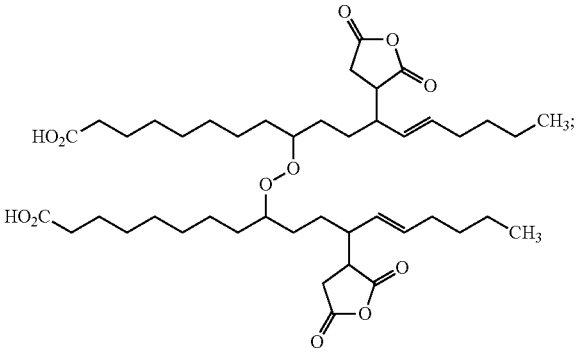
(XVII)
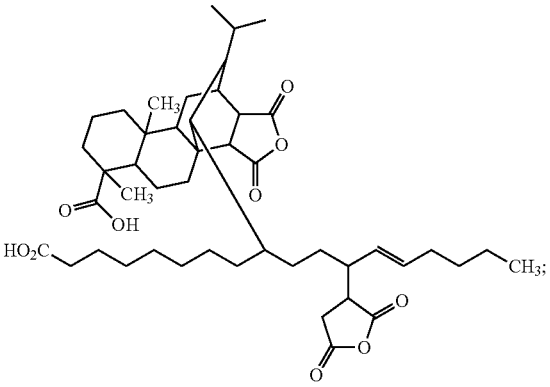
(XVIII)
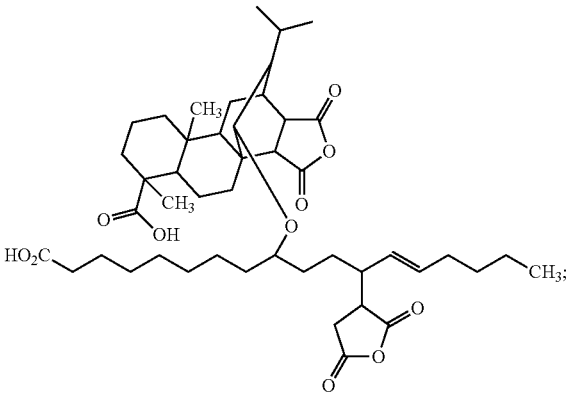
(XIX)
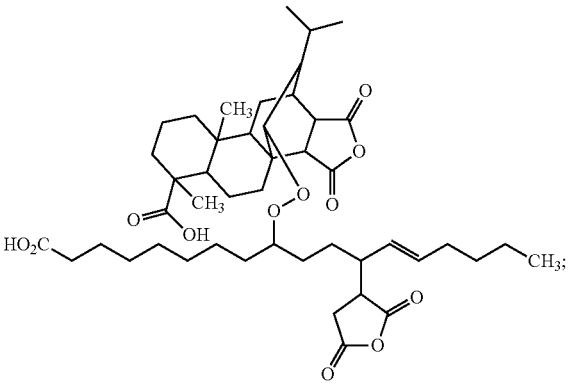
(XX)
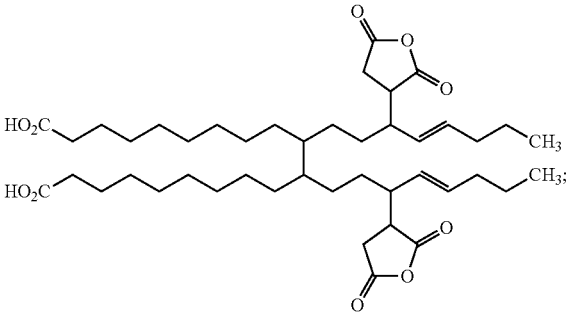
(XXI)
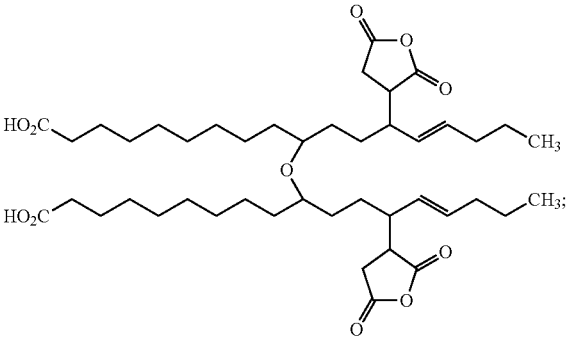
(XXII)
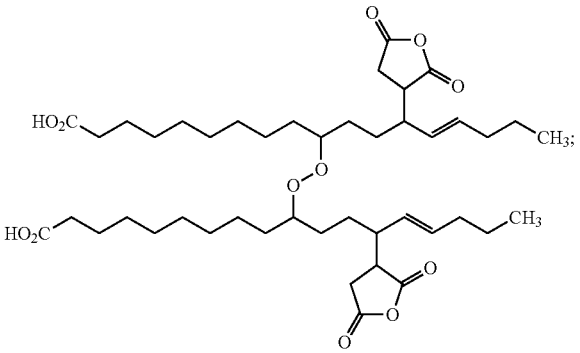
(XXIII)
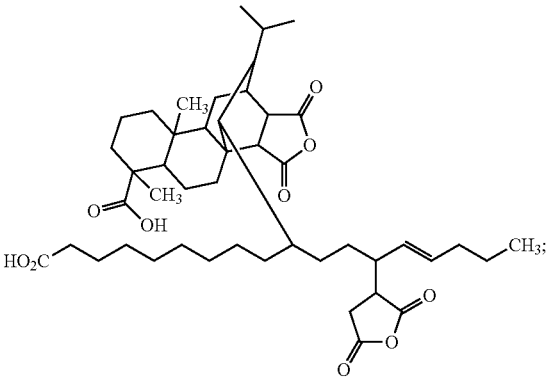

-continued
(XXIV)
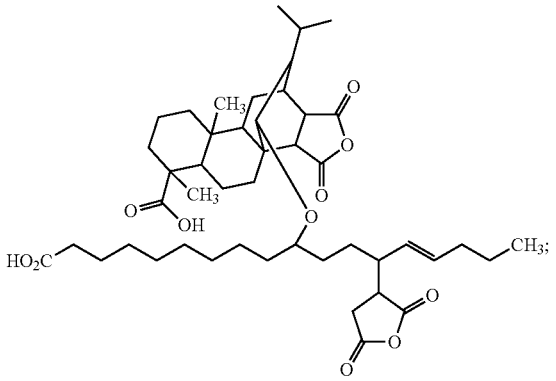
(XXV)
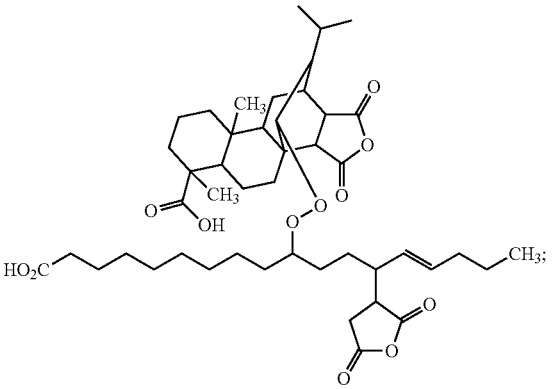
(XXVI)
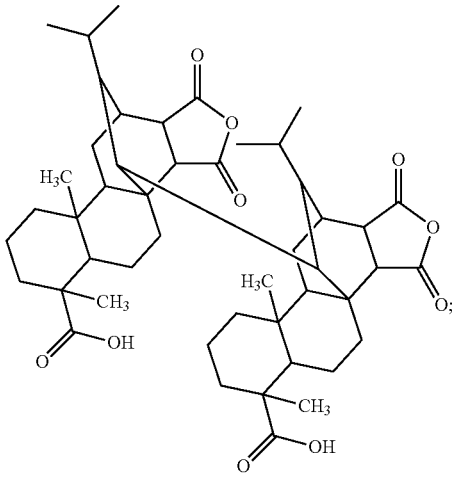
(XXVII)
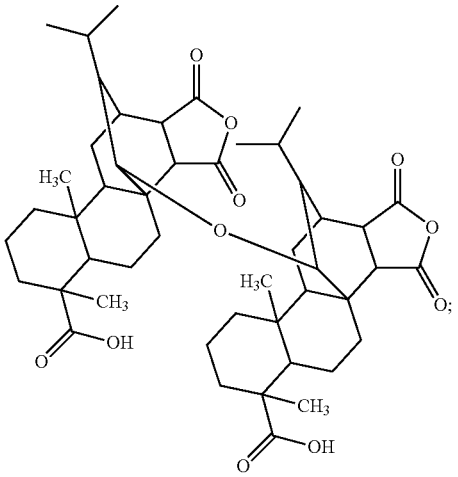
(XXVIII)
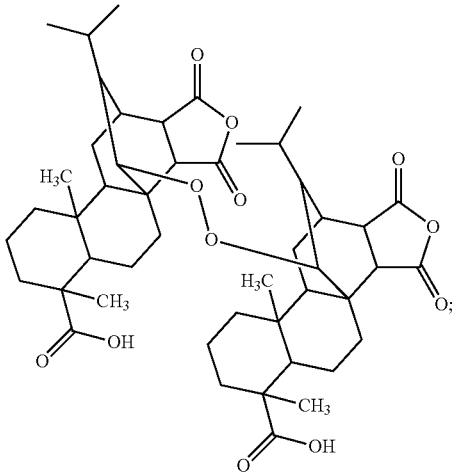
(XXIX)
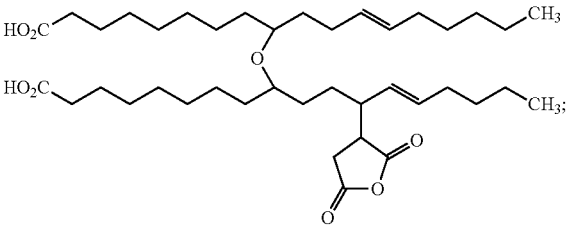
(XXX)
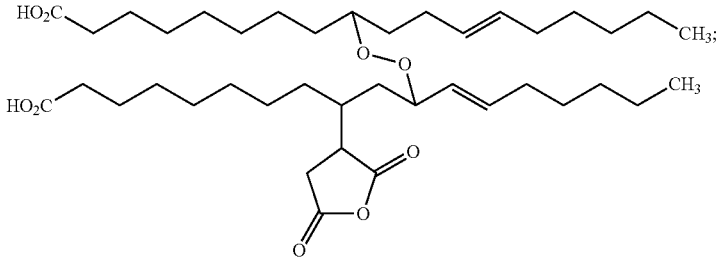

-continued (XXXI)

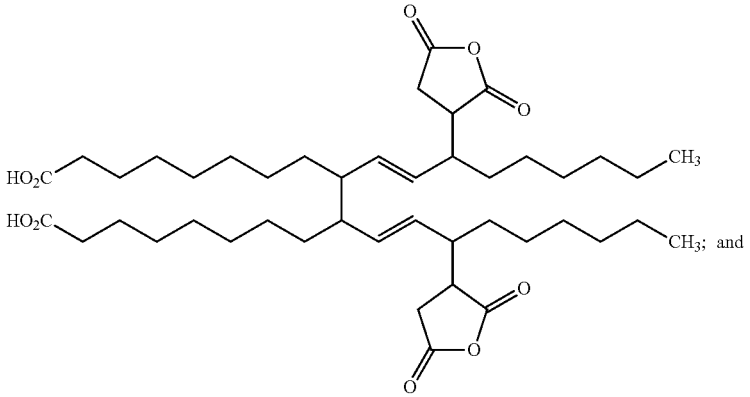

(XXXII)

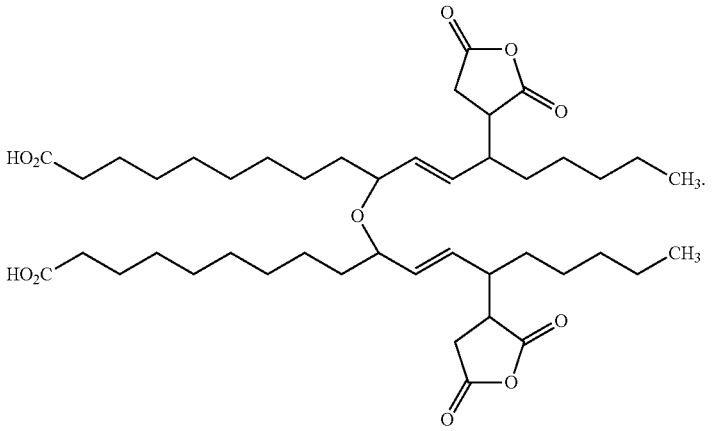

C. Oxidized Fatty Acid Compositions

Oxidized fatty acid compositions provided herein comprise one or more oxidized fatty acid compounds, wherein when the composition comprises more than one oxidized fatty acid compound, the oxidized fatty acid compounds can be the same or different. Non-limiting examples of oxidized fatty acid compositions, are compositions comprising one or more of the oxidized fatty acid compounds disclosed above, such as compositions containing one or more of oxidized decenoic acid; oxidized dodecenoic acid; oxidized cis-9-tetradecenoic acid; oxidized cis-9-hexadecenoic acid; oxidized oleic acid; oxidized linoleic acid; oxidized linolenic acid; oxidized cis-6,cis-9,cis-12,cis-15-octadecatetraenoic acid; oxidized ricinoleic acid; oxidized cis-9-eicosenoic acid; oxidized cis-11-eicosenoic acid; oxidized eicosadienoic acid; oxidized eicosatrienoic acid; oxidized arachidonic acid; oxidized eicosapentaenoic acid; oxidized erucic acid; oxidized docosadienoic acid; oxidized 4,8,12,15,19-docosapentaenoic acid; oxidized docosahexaenoic acid; and oxidized tetracosenoic acid. In some embodiments, an oxmal composition comprises one or more of oxidized oleic acid; oxidized linoleic acid; oxidized linolenic acid; oxidized cis-9-eicosenoic acid; and oxidized cis-11-eicosenoic acid. In another embodiment, the composition has one or more of oxidized oleic acid; oxidized linoleic acid; and oxidized linolenic acid. In a further embodiment, the composition includes oxidized oleic acid. In a further embodiment, the composition includes one or more compounds of Formulas 1-5 (see, e.g., Example 2).

In some embodiments, the oxidized fatty acid compositions are a source of fatty acids and mixtures of fatty acids that have been oxidized. Sources of fatty acids can be, for example, any natural or synthetic oil, including algal produced and microbial produced oil, that includes at least one site of unsaturation. In certain cases, the distillation products or distillation residues of such oils can serve as the source of fatty acids (e.g. distilled tall oil and tall oil distillation bottoms). In some embodiments, the natural or synthetic oil includes one site of unsaturation, two sites of unsaturation, or more. In some embodiments, the natural or synthetic oil includes at least one site of unsaturation. In some embodiments, the natural or synthetic oil comprises fatty acids having from 10 to 24 carbons and at least one site of unsaturation. In some embodiments, the natural or synthetic oil comprises a fatty acid having from 16 to 22 carbons and from one to five sites of unsaturation. In some embodiments, the natural or synthetic oil comprises a fatty acid having from 16 to 22 carbons and from one to three sites of unsaturation. In some embodiments, the natural or synthetic oil comprises a fatty acid having 18 carbons and two sites of unsaturation. In other embodiments, these oils can contain a fatty acid having 14 carbons and three sites of unsaturation. In some embodiments, these oils can contain a mixture of fatty acids and rosin acids. In some embodiments, these oils can contain as one significant constituent, linoleic acid, an unsaturated long chain fatty acid, and may also contain other unsaturated fatty acids and rosin acids. In another embodiment, these oils can contain as one significant constituent, oleic acid.

Natural sources of fatty acids, include plant- or animal-based oil compositions. For example, plant- and animal-based oils having unsaturated fatty acids which can be oxidized to produce oxidized fatty acid compositions according to the invention. Depending on the level of oxidation, the compositions may also include unreacted or partially reacted species such as free fatty acid. Non-limiting examples of plant- and animal-based oils include: canola oil; castor oil; coco butter; coconut oil; corn oil; cotton seed oil; crambe oil; linseed oil; olive oil; palm kernel oil; palm oil; peanut oil; rape seed oil; safflower oil; soybean oil; sunflower seed oil; tall oil; tung oil; butter; lard; tallow; yellow grease; and fish oil (e.g., herring oil, menhaden oil, and sardine oil). Oils can be oxidized directly, or if present in a combined form such as triglycerides, can be saponified to their component fatty acids prior to oxidation. In certain embodiments, the source of fatty acids is a plant- or animal-based oil chosen from fish oil, corn oil, soybean oil, and tall oil.

In certain embodiments, the source of fatty acids is a plant-based oil chosen from tall oils and tall oil products. In some embodiments, the tall oil products are oxidized tall oil products. More generally, non-limiting examples of tall oil sources of fatty acids include various tall oil products such as without limitation a tall oil itself, crude tall oil, distilled tall oil products, tall oil fatty acid (TOFA), tall oil distillation bottoms, and specialty tall oil products such as those provided by Georgia-Pacific Chemicals LLC, Atlanta, Ga. For example, tall oil distillation products having greater than about 90% tall oil fatty acid and less than about 6% rosin acid, such as XTOL® 100, XTOL® 101, XTOL® 300, and XTOL® 304; tall oil distillation products such as XTOL® 520, XTOL® 530 and XTOL® 542; tall oil distillation products having at least about 90% rosin acid and less than about 5% tall oil fatty acid, such as LYTOR® 100; oxidized crude tall oil compositions, such as XTOL® MTO; and blends thereof. In some embodiments, such as when the tall oil product is purchased as an oxidized tall oil product, the product may be used without further modification.

Sources of fatty acids can include various amounts of the fatty acids, including various amounts of different fatty acids. In some embodiments, a source of fatty acid can also include rosin acid. For example, TOFA can contain oleic acid, linoleic acid, and linolenic acid, as well as rosin acids, such as abietic and pimaric acid. In some cases, the compositions may further include unsaponifiables or neutral compounds, such as hydrocarbons, higher alcohols, and sterols.

In certain embodiments, a blend of tall oil fatty acid and rosin acid can be used as the source of fatty acids to be oxidized. Such a blend can contain, for example, from about 20% to 99% tall oil fatty acid (e.g., 20%, 25%, 30%, 45%, 50%, 60%, 75%, 82%, 90%, and 99%). In some embodiments, a blend can further contain about 1% to about 55% rosin acid (e.g., 1%, 2.5%, 5%, 10%, 15%, 20%, 25%, 30%, 40%, 50%, and 55%). In some embodiments a blend can contain about 45% to about 90% tall oil fatty acid. In some embodiments a blend can contain about 30% tall oil fatty acid and about 30% rosin acid. In another embodiment, the ratio of tall oil fatty acid to rosin acid can be from about 3:2 to about 4:1 (e.g., 3:2, 4:2, 3:1, and 4:1).

As one non-limiting example, the oxidized fatty acid composition can be a crude tall oil composition that has been oxidized. As another non-limiting example, the oxidized fatty acid composition can be a tall oil fatty acid (TOFA) composition that has been oxidized.

In some embodiments, the oxidized fatty acid composition is an oxidized tall oil product. As one non-limiting example, the oxidized fatty acid composition is a XTOL® MTO.

In some embodiments, an oxidized fatty acid composition can have one or more oxidized fatty acid compounds which are in a salt form. Without being bound by theory, a salt form of an oxidized fatty acid compound can increase the aqueous solubility of the oxidized fatty acid compound. In some embodiments, at least about 10% (e.g., at least about 15%, at least about 20%, at least about 25%, at least about 30%, at least about 35%, at least about 40%, at least about 45%, at least about 50%, at least about 55%, at least about 60%, at least about 70%, at least about 75%, at least about 80%, at least about 85%, at least about 90%, and at least about 95%) of the oxidized fatty acid compounds in an oxidized fatty acid composition can be in a salt form. In some embodiments, at least about 30% of the oxidized fatty acid compounds in an oxidized fatty acid composition can be in a salt form.

In another embodiment, an oxidized fatty acid composition can include an acid compound having at least a first backbone and a second backbone linked by a linking group. The linking group can be a direct bond, an ether linkage, or a peroxide linkage.

In certain embodiments, an oxidized fatty acid composition can include compounds having at least two acid functionalities (e.g., two, three, four, five, six, seven, eight, nine, ten, eleven, or twelve acid functionalities). In some embodiments, an oxidized fatty acid composition can include compounds having at least three acid functionalities. An acid functionality includes anhydrides which can hydrolyze to form acids.

An oxidized fatty acid composition can be characterized by its acid value. As used herein, an "acid value" is the mass of potassium hydroxide (KOH) in milligrams that is required to neutralize one gram of an oxidized fatty acid composition. The acid value can be used as a measure of the amount of carboxylic acid groups in an oxidized fatty acid composition. In a typical procedure, a known amount of an oxidized fatty acid composition is dissolved in organic solvent and is titrated with a solution of potassium hydroxide of known concentration. The acid value can be determined by using a potassium hydroxide solution that contains phenolphthalein as a color indicator or using potentiometric analysis. Standard methods used for determining acid value are ASTM D 465-05 and AOCS Te 1a-64.

In some embodiments, the acid value can be from about 50 mg KOH/g to about 200 mg KOH/g (e.g., 60 mg KOH/g; 80 mg KOH/g, 100 mg KOH/g; 120 mg KOH/g; 150 mg KOH/g; 160 mg KOH/g; 170 mg KOH/g; 180 mg KOH/g; and 200 mg KOH/g). In some embodiments, the acid value can be from about 80 mg KOH/g to about 200 mg KOH/g. In some embodiments, the acid value can be from about 100 mg KOH/g to about 180 mg KOH/g. In certain embodiments, the acid value can range from about 120 mg KOH/g to about 150 mg KOH/g. In other embodiments, the acid value is about 130 mg KOH/g. In some embodiments, the acid value is at least about 80 mg KOH/g. In some embodiments, the acid value is at least about 110 mg KOH/g.

Viscosity of an oxidized fatty acid composition is another method of characterizing these compositions. Without being bound by theory, the viscosity of an oxidized fatty acid composition increases, compared to the viscosity of the starting composition, with an increase in acid functionality, e.g., the number of acid groups or groups, such as anhydrides which can hydrolyze to form acids. Both a Gardner-Holdt and a Brookfield Viscosity value can be used to characterize an oxidized fatty acid composition. An apparent viscosity can be determined using a Brookfield viscometer. This measures the torque required to rotate a spindle at constant speed in a solution of an oxidized fatty acid composition at 25° C. Standard test methods used for measuring Brookfield viscosity are ASTM D 803-03 and AOCS Ja 10-87 (93). In certain embodiments, the viscosity range for the oxidized fatty acid products can range from about 1000 to about 6000 cPs at 25° C. In some embodiments, the viscosity range for the oxidized fatty acid products can range from about 1300 to about 5000 cPs at 25° C. In some embodiments, the viscosity range for the oxidized fatty acid products can range from about 3000 to about 4000 cPs at 25° C. Standard test methods for determining Gardner-Holdt viscosity are ASTM D1545-07 and AOCS Ja 11-87 (93).

In some embodiments, the oxidized fatty acid compositions described above can be oxidized clean fatty acid compositions as defined herein.

D. Oxmal Compositions

Oxmal compositions provided herein comprise one or more oxmal compounds, wherein when the composition comprises more than one oxmal compound, the oxmal compounds can be the same or different. Non-limiting examples of oxmal compositions, are compositions comprising one or more of the oxmal compounds disclosed above, such as compositions containing one or more of oxidized and maleated decenoic acid; oxidized and maleated dodecenoic acid; oxidized and maleated cis-9-tetradecenoic acid; oxidized and maleated cis-9-hexadecenoic acid; oxidized and maleated oleic acid; oxidized and maleated linoleic acid; oxidized and maleated linolenic acid; oxidized and maleated cis-6,cis-9,cis-12,cis-15-octadecatetraenoic acid; oxidized and maleated ricinoleic acid; oxidized and maleated cis-9-eicosenoic acid; oxidized and maleated cis-11-eicosenoic acid; oxidized and maleated eicosadienoic acid; oxidized and maleated eicosatrienoic acid; oxidized and maleated arachidonic acid; oxidized and maleated eicosapentaenoic acid; oxidized and maleated erucic acid; oxidized and maleated docosadienoic acid; oxidized and maleated 4,8,12,15,19-docosapentaenoic acid; oxidized and maleated docosahexaenoic acid; and oxidized and maleated tetracosenoic acid. In some embodiments, an oxmal composition comprises one or more of oxidized and maleated oleic acid; oxidized and maleated linoleic acid; oxidized and maleated linolenic acid; oxidized and maleated cis-9-eicosenoic acid; and oxidized and maleated cis-11-eicosenoic acid. In another embodiment, the composition has one or more of oxidized and maleated oleic acid; oxidized and maleated linoleic acid; and oxidized and maleated linolenic acid. In a further embodiment, the composition includes oxidized and maleated oleic acid. In a further embodiment, the composition includes one or more compounds of Formulas 8-32.

In some embodiments, the oxmal compositions are a source of fatty acids, rosin acids, and mixtures of fatty acids and rosin acids that have been oxidized and/or maleated. Sources of fatty acids, rosin acids, and mixtures thereof, can be, for example, any natural or synthetic oil, including algal produced and microbial produced oil, that includes at least one site of unsaturation. In certain cases, the distillation products or distillation residues of such oils can serve as the source of fatty acids, rosin acids, and mixtures thereof (e.g. distilled tall oil and tall oil distillation bottoms). In some embodiments, the natural or synthetic oil includes one site of unsaturation, two sites of unsaturation, or more. In some embodiments, the natural or synthetic oil includes at least one site of unsaturation. In some embodiments, the natural or synthetic oil comprises from 10 to 24 carbons and at least one site of unsaturation. In some embodiments, the natural or synthetic oil comprises from 16 to 22 carbons and from one to five sites of unsaturation. In some embodiments, the natural or synthetic oil comprises from 16 to 22 carbons and from one to three sites of unsaturation. In some embodiments, the natural or synthetic oil comprises 18 carbons and two sites of unsaturation. In other embodiments, these oils can contain a fatty acid having 14 carbons and three sites of unsaturation. In some embodiments, these oils can contain as one significant constituent, linoleic acid, an unsaturated long chain fatty acid, and may also contain other unsaturated fatty acids and rosin acids. In another embodiment, these oils can contain as one significant constituent, oleic acid.

Natural sources of fatty acids, rosin acids, and mixtures thereof, include plant- or animal-based oil compositions. For example, plant- and animal-based oils having double bonds, i.e., sites of unsaturation in their hydrocarbon chains can be oxidized and maleated to produce oxmal compositions according to the invention. Depending on the level of maleation, the compositions may also include unreacted or partially reacted species such as free fatty acid and rosin acid, maleated but not oxidized fatty acid and rosin acid, oxidized but not maleated fatty acid and rosin acid, and oxidized and partially maleated fatty acid and rosin acid. Non-limiting examples of plant- and animal-based oils include: canola oil; castor oil; coco butter; coconut oil; corn oil; cotton seed oil; crambe oil; linseed oil; olive oil; palm kernel oil; palm oil; peanut oil; rape seed oil; safflower oil; soybean oil; sunflower seed oil; tall oil; tung oil; butter; lard; tallow; yellow grease; and fish oil (e.g., herring oil, menhaden oil, and sardine oil). Oils can be oxidized and/or maleated directly, or if present in a combined form such as triglycerides, can be saponified to their component fatty acids before the oxidation and/or maleation reactions.

In certain embodiments, the source of fatty acids, rosin acids, and/or mixtures thereof is a plant- or animal-based oil chosen from fish oil, corn oil, soybean oil, and tall oil.

In certain embodiments, the source of fatty acids, rosin acids, and/or mixtures thereof is a plant-based oil chosen from tall oils and tall oil products. In some embodiments, tall oil products are maleated tall oil products. In some embodiments, the tall oil products are oxidized tall oil products. More generally, non-limiting examples of tall oil sources of fatty acids, rosin acids, and mixtures thereof include various tall oil products such as without limitation a tall oil itself, crude tall oil, distilled tall oil products, tall oil fatty acid (TOFA), TOFA which has been maleated in a range of from about 6% to about 25%, rosin acids, tall oil distillation bottoms, and specialty tall oil products such as those provided by Georgia-Pacific Chemicals LLC, Atlanta, Ga. For example, tall oil distillation products having greater than about 90% tall oil fatty acid and less than about 6% rosin acid, such as XTOL® 100, XTOL® 101, XTOL® 300, and XTOL® 304; tall oil distillation products such as XTOL® 520, XTOL® 530 and XTOL® 542; tall oil distillation products having at least about 90% rosin acid and less than about 5% tall oil fatty acid, such as LYTOR® 100; tall oil blends of tall oil fatty acid distillation bottoms and a distilled tall oil, which blend has been maleated, such as XTOL® 690, XTOL® 692; oxidized crude tall oil compositions, such as XTOL® MTO; and blends thereof.

Sources of fatty acids, rosin acids, and mixtures thereof can include various amounts of the fatty acids, rosin acids, and mixtures thereof, including various amounts of different fatty acids and rosin acids. For example, TOFA can contain oleic acid, linoleic acid, and linolenic acid, as well as rosin acids, such as abietic and pimaric acid. In some cases, the compositions may further include unsaponifiables or neutral compounds, such as hydrocarbons, higher alcohols, and sterols when using certain tall oil fractions.

In certain embodiments, a blend of tall oil fatty acid and rosin acid can be used as the source of fatty acids and rosin acids (i.e. the source of hydrocarbon-based backbone structures) to be oxidized and maleated. Such a blend can contain, for example, from about 20% to 99% tall oil fatty acid (e.g., 20%, 25%, 30%, 45%, 50%, 60%, 75%, 82%, 90%, and 99%) and about 1% to about 55% rosin acid (e.g., 1%, 2.5%, 5%, 10%, 15%, 20%, 25%, 30%, 40%, 50%, and 55%). In some embodiments a blend can contain about 45% to about 90% tall oil fatty acid. In some embodiments a blend can contain about 30% tall oil fatty acid and about 30% rosin acid. In another embodiment, the ratio of tall oil fatty acid to rosin acid can be from about 3:2 to about 4:1 (e.g., 3:2, 4:2, 3:1, and 4:1).

As one non-limiting example, the oxmal composition can be a crude tall oil composition that has been oxidized and maleated (see Example 5). As another non-limiting example, the oxmal composition can be a tall oil fatty acid (TOFA) composition that has been oxidized and maleated (see Example 6).

In some embodiments, the oxmal compositions are a source of maleated tall oil product that has been oxidized. As one non-limiting example, the oxmal composition is a XTOL® 690 that has been oxidized (see Example 3). As another non-limiting example, the oxmal composition is a XTOL® 692 that has been oxidized (see Example 3).

In some embodiments, the oxmal composition is a source of oxidized tall oil product that has been maleated. As one non-limiting example, the oxmal composition is a XTOL® MTO that has been maleated (see Example 4).

In some embodiments, an oxmal composition can have one or more oxmal compounds which are in a salt form. Without being bound by theory, a salt form of an oxmal compound can increase the aqueous solubility of the oxmal compound. In some embodiments, at least about 10% (e.g., at least about 15%, at least about 20%, at least about 25%, at least about 30%, at least about 35%, at least about 40%, at least about 45%, at least about 50%, at least about 55%, at least about 60%, at least about 70%, at least about 75%, at least about 80%, at least about 85%, at least about 90%, and at least about 95%) of the oxmal compounds in an oxmal composition can be in a salt form. In some embodiments, at least about 30% of the oxmal compounds in an oxmal composition can be in a salt form.

In another embodiment, an oxmal composition can include an acid compound having at least a first backbone and a second backbone linked by a linking group. The linking group can be a direct bond, an ether linkage, or a peroxide linkage. In some embodiments, the first and second backbone can be independently chosen from a maleated unsaturated fatty acid or maleated rosin acid. In some embodiments, the first backbone is chosen from a maleated unsaturated fatty acid or maleated rosin acid and the second backbone is chosen from an unsaturated fatty acid or rosin acid.

Non-limiting examples of maleated unsaturated fatty acids can include: maleated decenoic acid; maleated dodecenoic acid; maleated cis-9-tetradecenoic acid; maleated cis-9-hexadecenoic acid; maleated oleic acid; maleated linoleic acid; maleated linolenic acid; maleated cis-6,cis-9,cis-12,cis-15-octadecatetraenoic acid; maleated ricinoleic acid; maleated cis-9-eicosenoic acid; maleated cis-11-eicosenoic acid; maleated eicosadienoic acid; maleated eicosatrienoic acid; maleated arachidonic acid; maleated eicosapentaenoic acid; maleated erucic acid; maleated docosadienoic acid; maleated 4,8,12,15,19-docosapentaenoic acid; maleated docosahexaenoic acid; and maleated tetracosenoic acid.

In certain embodiments, the maleated unsaturated fatty acid is maleated oleic acid; maleated linoleic acid; maleated linolenic acid; maleated cis-9-eicosenoic acid; or maleated cis-11-eicosenoic acid. In another embodiment, the maleated unsaturated fatty acid is maleated oleic acid; maleated linoleic acid; and maleated linolenic acid. In a further embodiment, the maleated unsaturated fatty acid is maleated oleic acid.

In certain embodiments, an oxmal composition can include compounds having at least three acid functionalities (e.g., three, four, five, six, seven, eight, nine, ten, eleven, or twelve acid functionalities). In some embodiments, an oxmal composition can include compounds having at least six acid functionalities. An acid functionality includes anhydrides which can hydrolyze to form acids.

In certain embodiments, the oxmal composition can be maleated from about 2% to about 40% by weight (e.g., 2%, 3.5%, 5%, 6%, 7.5%, 8%, 10%, 12%, and 15%). In some embodiments, the percent maleation is from about 2% to about 25% by weight. In one embodiment, the percent maleation is 3.5% by weight, while in another embodiment, the percent maleation is 12% by weight. In some embodiments, the percent maleation is 5% by weight. In some embodiments, the percent maleation is 6% by weight. The composition of products prepared is related to the percent maleation performed. Accordingly, in some oxmal compositions, oxmal compounds may include compounds that have been maleated, for example, on at least one hydrocarbon-based backbone structure, at least two hydrocarbon-based backbone structures, on all hydrocarbon-based backbone structures. In certain embodiments, an oxmal composition may further comprise compounds that have been oxidized but have not been maleated.

An oxmal composition can be characterized by its acid value. As used herein, an "acid value" is the mass of potassium hydroxide (KOH) in milligrams that is required to neutralize one gram of an oxmal composition. The acid value can be used as a measure of the amount of carboxylic acid groups in an oxmal composition. In a typical procedure, a known amount of an oxmal composition is dissolved in organic solvent and is titrated with a solution of potassium hydroxide of known concentration. The acid value can be determined by using a potassium hydroxide solution that contains phenolphthalein as a color indicator or using potentiometric analysis. Standard methods used for determining acid value are ASTM D 465-05 and AOCS Te 1a-64.

In some embodiments, the acid value can be from about 50 mg KOH/g to about 400 mg KOH/g (e.g., 65 mg KOH/g; 100 mg KOH/g; 150 mg KOH/g, 200 mg KOH/g; 250 mg KOH/g; 330 mg KOH/g; and 400 mg KOH/g). In some embodiments, the acid value can be from about 150 mg KOH/g to about 300 mg KOH/g. In some embodiments, the acid value can be from about 150 mg KOH/g to about 225 mg KOH/g. In certain embodiments, the acid value can range from about 200 mg KOH/g to about 300 mg KOH/g. In other embodiments, the acid value is about 200 mg KOH/g.

Viscosity of an oxmal composition is another method of characterizing these compositions. Without being bound by theory, the viscosity of an oxmal composition increases, compared to the viscosity of the starting composition, with an increase in acid functionality, e.g., the number of acid groups or groups, such as anhydrides which can hydrolyze to form acids. Both a Gardner-Holdt and a Brookfield Viscosity value can be used to characterize an oxmal composition. An apparent viscosity can be determined using a Brookfield viscometer. This measures the torque required to rotate a spindle at constant speed in a solution of an oxmal composition at 25° C. Standard test methods used for measuring Brookfield viscosity are ASTM D 803-03 and AOCS Ja 10-87 (93). In certain embodiments, the viscosity range for the oxmal products can range from about 1000 to 27,000 cPs at 25° C. Standard test methods for determining Gardner-Holdt viscosity are ASTM D1545-07 and AOCS Ja 11-87 (93).

III. Preparation of Collector Compounds and Compositions

A. Preparation of Oxidized Fatty Acid Compounds and Compositions

Processes for preparing oxidized fatty acid compounds and compositions, as described above, are known in the art. The Examples and descriptions herein provide examples of methods of making compositions, but the chemistry is equally applicable to methods of making compounds.

In some embodiments, an oxidized fatty acid compound is prepared by oxidizing a fatty acid backbone structure having at least one site of unsaturation and at least one allylic site. In some embodiments, the fatty acid backbone structure is a $C_{16}$ or $C_{18}$ fatty acid, such as for example oleic acid, linoleic acid, and linolenic acid.

In some embodiments, the composition can comprise (i.e. the fatty acid backbone structures are) fatty acids, distillation products thereof, or mixtures thereof. In some embodiments, the compositions are chosen from tall oil, animal oils, plant oils, algal produced oils, microbial produced oils, distillation products thereof, and mixtures thereof. A person of ordinary skill will appreciate that certain of these oils or products thereof may have to be saponified prior to oxidation to obtain an appropriate fatty acid backbone structure.

In some embodiments, suitable oils which can be used for preparing an oxidized fatty acid composition include without limitation: linseed (flaxseed) oil, castor oil, tung oil, soybean oil, cottonseed oil, olive oil, canola oil, corn oil, sunflower seed oil, coconut oil, rape seed oil, safflower oil, tall oil, palm oil, the distillation products thereof, and mixtures thereof. These oils contain as one constituent linoleic acid, an unsaturated long chain fatty acid as well as other unsaturated fatty acids. In some embodiments, suitable oils include without limitation fish oil, such as herring oil, menhaden oil, and sardine oil. In some embodiments, a suitable oil is tall oil.

In some embodiments, the composition can comprise animal oil fatty acids, plant oil fatty acids, algal oil fatty acids, microbially derived fatty acids, and mixtures thereof.

In some embodiments, oxidation is accomplished by heating the compositions containing the fatty acid backbone structures, such as for example tall oils, in the presence of oxygen or air. Unsaturated fatty acids can be polymerized by heating them in the presence of oxygen or air. This polymerization can cause an increase in the viscosity of the oxidized fatty acid composition. A catalyst can be used to increase the speed of the oxidation reaction in order to reduce the time required to attain the desired level of oxidation and associated viscosity increase, or to reduce the temperature at which the oxidation is conducted. Use of such a catalyst is optional. Without being bound by theory, the oxidative heating treatment is believed to cause crosslinking of the fatty acids via their double bonds (sites of unsaturation) and allylic sites, via a direct bond, an ether linkage, or a peroxide linkage. The oxidation treatment is continued until a desired result is obtained, for example, a desired acid value or a desired viscosity.

In some embodiments, the process of producing an oxidized fatty acid composition involves oxidizing a tall oil composition by heating the tall oil material to a temperature at least about 150° C., for example to a temperature in the range of about 160° C. to about 170° C., followed by sparging oxygen or air through the heated tall oil composition. As understood by those skilled in the art, a variety of techniques and devices can advantageously be used to inject the oxygen or air into the heated tall oil and the present method is not limited to any specific technique or equipment. As discussed above, the oxidation reaction can be continued until the desired acid value or viscosity is achieved in the tall oil, indicative that the desired level of cross-linking has been obtained in the oxidized tall oil material.

In some embodiments, tall oil distillate components suitable for use in the process of making an oxidized fatty acid composition include without limitation: fatty acids, tall oil rosin acids, and mixtures of these fractions. The refinement (i.e. fractionation) of tall oil can, for example, provide $C_{16}$-$C_{18}$ saturated and unsaturated fatty acids as well as fatty acid/rosin acid mixtures. In preparing oxidized tall oil, such tall oil distillate components, lighter (i.e. lower boiling) or heavier (i.e. higher boiling) components, or components having broader or narrower boiling point ranges may be used in the reaction. Mixtures or blends of various tall oil distillate fractions may also be employed as the tall oil material. Fatty acid/rosin acid mixtures in a desired ratio may be obtained in a single distillate fraction by adjusting tall oil fractionation conditions. Representative tall oil distillate components include commercially available products XTOL® 100, XTOL® 300, XTOL® 304, and XTOL® 520 (from Georgia-Pacific Chemicals LLC, Atlanta, Ga.).

In one embodiment, for example, a mixture of a first tall oil distillate fraction comprising predominantly tall oil fatty acids (e.g., XTOL® 100) and a second tall oil distillate fraction comprising predominantly rosin acids (e.g., LYTOR® 100) may be blended in a wide range of proportions. In such mixtures, representative amounts of fatty acids and rosin acids range from about 20% to about 99% by weight and from about 1% to about 55% by weight, respectively. Representative weight ratios of the first tall oil distillate fraction to the second tall oil distillate fraction may range from about 3:2 to about 4:1. Depending on the tall oil composition and fractionation conditions, a single tall oil distillate fraction may also suffice to yield a composition that is substantially the same as any of the blends of tall oil distillate fractions discussed above.

B. Preparation of Oxmal Compounds and Compositions

Processes for preparing oxmal compounds and compositions, as described above, are also provided herein. Although the examples and descriptions herein emphasize methods of making compositions, the chemistry is equally applicable to methods of making compounds.

In some embodiments, an oxmal compound is prepared by oxidizing and maleating a hydrocarbon-based backbone structure having at least one site of unsaturation and at least one reactive allylic site. The hydrocarbon-backbone based structure can be, for example, a fatty acid, a rosin acid, or a polyolefin oligomer with at least one reactive allylic site. In some embodiments, the hydrocarbon-backbone structure is a $C_{16}$ or $C_{18}$ fatty acid, such as for example oleic acid, linoleic acid, and linolenic acid. In some embodiments, the backbone structure is first oxidized and than maleated. In some embodiments, the backbone structure is first maleated and then oxidized.

In some embodiments, an oxmal composition is prepared by the process of: (a) maleating a composition comprising one or more hydrocarbon-based backbone structures having at least one site of unsaturation; and (b) oxidizing the composition. In some embodiments, step (a) is performed before step (b), while in other embodiments, step (b) is performed before step (a). In some embodiments, the composition can comprise (i.e. the hydrocarbon-based backbone structures are) fatty acids, rosin acids, distillation products thereof, or mixtures thereof. In some embodiments, the compositions are chosen from tall oil, animal oils, plant oils, algal produced oils, microbial produced oils, distillation products thereof, and mixtures thereof. A person of ordinary skill will appreciate that certain of these oils or products thereof may have to be saponified prior to oxidation and maleation to obtain an appropriate backbone structure, or a fatty acid.

In some embodiments, suitable oils which can be used for preparing an oxidized and maleated composition include without limitation: linseed (flaxseed) oil, castor oil, tung oil, soybean oil, cottonseed oil, olive oil, canola oil, corn oil, sunflower seed oil, coconut oil, rape seed oil, safflower oil, tall oil, palm oil, the distillation products thereof, and mixtures thereof. These oils contain as one constituent linoleic acid, an unsaturated long chain fatty acid as well as other unsaturated fatty acids. In some embodiments, suitable oils include without limitation fish oil, such as herring oil, menhaden oil, and sardine oil.

In some embodiments, the compositions can comprise animal oil fatty acids, plant oil fatty acids, algal oil fatty acids, microbially derived fatty acids, and mixtures thereof.

In the preparation of an oxmal composition, as with the preparation of an oxmal compound, the oxidation and the maleation of the hydrocarbon-backbone structures of the composition can be conducted in either order. For example, a fatty acid composition can first be maleated and then the maleation can be followed by an oxidation (see Example 4 and 5). Alternatively, the fatty acid composition can first be oxidized and then the oxidized composition can be maleated (see Example 3).

In some embodiments, the process of making an oxmal composition comprises oxidizing a commercially available maleated fatty acid composition, such as without limitation XTOL® 690 or XTOL® 692. In some embodiments, the process of making an oxmal composition comprises maleating a commercially available oxidized tall oil composition, such as without limitation XTOL® MTO.

In some embodiments, oxidation is accomplished by heating the compositions containing the hydrocarbon-backbone based structures, such as for example tall oils, in the presence of oxygen or air. Unsaturated hydrocarbon-based structures can be polymerized by heating them in the presence of oxygen or air. This polymerization can cause an increase in the viscosity of the oxmal composition. A catalyst can be used to increase the speed of the oxidation reaction in order to reduce the time required to attain the desired level of oxidation and associated viscosity increase, or to reduce the temperature at which the oxidation is conducted. Use of such a catalyst is optional. In some embodiments, a hydrocarbon-based structure can be a fatty acid, rosin acid, or mixtures thereof. Without being bound by theory, the oxidative heating treatment is believed to cause crosslinking of the hydrocarbon chains acid via their double bonds (sites of unsaturation) and allylic sites, via a direct bond, an ether linkage, or a peroxide linkage. The oxidation treatment is continued until a desired result is obtained, for example, a desired acid value or a desired viscosity.

In some embodiments, the oxidation step in the process of producing an oxmal composition involves oxidizing a tall oil composition by heating the tall oil material to a temperature at least about 150° C., for example to a temperature in the range of about 160° C. to about 170° C., followed by sparging oxygen or air through the heated tall oil composition. As understood by those skilled in the art, a variety of techniques and devices can advantageously be used to inject the oxygen or air into the heated tall oil and the present method is not limited to any specific technique or equipment. As discussed above, the oxidation reaction can be continued until the desired acid value or viscosity is achieved in the tall oil, indicative that the desired level of cross-linking has been obtained in the oxidized tall oil material.

In some embodiments, the maleation step in the process of producing an oxmal composition involves reaction of the hydrocarbon-based structures in the composition with one or more α,β unsaturated carboxylic acids or anhydrides. The amount of α,β unsaturated carboxylic acid or anhydride used varies based on the composition to be maleated. Suitable amounts of the anhydride (or acid(s)) may range from about 2% to about 40% by weight, based on the combined weight of the composition and the anhydride (or acid(s)) and/or the desired amount of maleation. In some embodiments, the amount of anhydride (or acid(s)) can range from about 2% to about 25% by weight, usually from about 2% to about 15% by weight, based on the combined weight of the composition and the anhydride (or acid(s)) and/or the desired amount of maleation. In some embodiments, the α,β unsaturated carboxylic acid or anhydride is chosen from maleic anhydride, fumaric acid, or (meth) acrylic acid. In some embodiments, the α,β unsaturated carboxylic acid or anhydride is a biogenically derived unsaturated carboxylic acid or anhydride. The composition of products prepared is related to the percent maleation performed. Accordingly, in some oxmal compositions, oxmal compounds may include compounds that have been maleated, for example, on at least one hydrocarbon-based backbone structure, at least two hydrocarbon-based backbone structures, on all hydrocarbon-based backbone structures. In certain embodiments, an oxmal composition may further comprise compounds that have been oxidized but have not been maleated.

In contrast to the prior art, where there apparently has been a concerted effort to use tall oil materials containing primarily, if not almost exclusively, tall oil fatty acids (TOFA) and to conduct the maleation reaction (e.g. the reaction with maleic anhydride and/or fumaric acid, and/or acrylic acid), in a way to promote the formation of the Diels-Alder reaction adduct with linoleic acid (generally by using a catalyst), the present inventors have found that such restrictions are not necessary. In some embodiments according to the invention, the conditions under which the maleation reaction proceeds do not need to be controlled (e.g. a catalyst is not needed) such that the Diels-Alder reaction predominates; there is no need to focus on the production of the Diels-Alder reaction adduct with conjugated fatty acids, such as linoleic acid.

For example, the maleation of a tall oil, such as without limitation a crude tall oil or tall oil distillate or component, proceeds by reaction of the tall oil and, for example, one or more of maleic anhydride, fumaric acid, and (meth)acrylic acid. Once combined, the reaction mixture is heated to a temperature of from about 150° C. to about 250° C. In certain embodiments, the reaction temperature is from about 200° C. to about 230° C. In other embodiments, the reaction temperature is from about 215° C. to about 225° C. In some embodiments, a catalyst can be used. Such catalysts are known in the art.

The maleation reaction is essentially complete after a reaction time from about 5 hours to about 36 hours, and typically from about 20 hours to about 30 hours. Without being bound by theory, the maleic anhydride, fumaric acid, and/or (meth)acrylic acid reacts with the hydrocarbon-based material, at the various sites of unsaturation present in the material. For example, the reaction of maleic anhydride with an unsaturated tall oil fatty acid results in the addition of the anhydride ring to the acid at olefinic sites via the so-called "ene" reaction. The reaction of maleic anhydride with a rosin acid derived from tall oil, at diolefinic sites and with conjugated unsaturated fatty acids, may alternatively form a Diels-Alder addition product having a 6-membered ring with one site of unsaturation. Non-limiting examples of representative reactions that can occur are illustrated in U.S. Pat. No. 4,927,669.

A representative set of structures of molecular species potentially found in maleated tall oil compositions (especially tall oil compositions maleated with maleic anhydride) suitable for use as the starting material for making chemically modified oxidized and maleated unsaturated fatty acid compositions include the Diels-Alder reaction product with conjugated linoleic acid and ene reaction products with oleic and elaidic acids as follows:

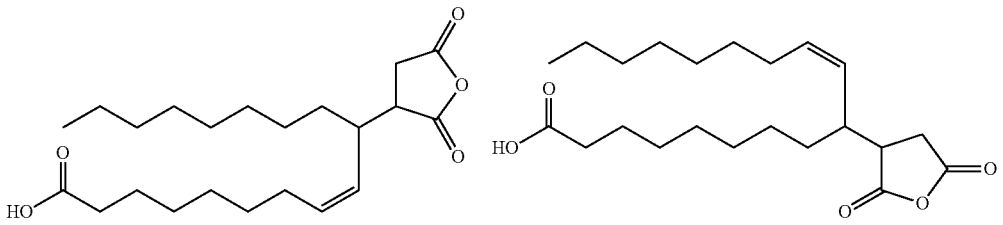

ENE-PRODUCTS

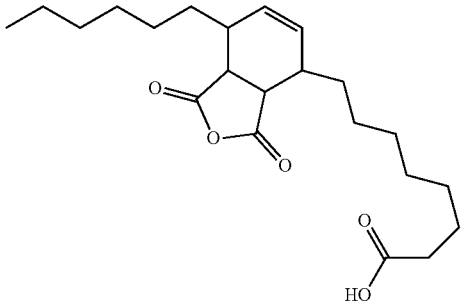

DIELS-ALDER PRODUCT

As will be appreciated by those skilled in the art, certain analogous structures are formed when using any α,β unsaturated carboxylic acid or anhydride for these maleation reactions.

In some embodiments, tall oil distillate components suitable for use in the process of making an oxmal composition include without limitation: fatty acids, tall oil rosin acids, and mixtures of these fractions. The refinement (i.e. fractionation) of tall oil can, for example, provide $C_{16}$-$C_{18}$ saturated and unsaturated fatty acids as well as fatty acid/rosin acid mixtures. In preparing maleated tall oil, such tall oil distillate components, lighter (i.e. lower boiling) or heavier (i.e. higher boiling) components, or components having broader or narrower boiling point ranges may be used in the reaction with an α,β unsaturated carboxylic acid or anhydride. Mixtures or blends of various tall oil distillate fractions may also be employed as the tall oil material. Fatty acid/rosin acid mixtures in a desired ratio may be obtained in a single distillate fraction by adjusting tall oil fractionation conditions. Representative tall oil distillate components include commercially available products XTOL® 100, XTOL® 300, XTOL® 304, and XTOL® 520 (from Georgia-Pacific Chemicals LLC, Atlanta, Ga.).

In one embodiment, for example, a mixture of a first tall oil distillate fraction comprising predominantly tall oil fatty acids (e.g., XTOL® 100) and a second tall oil distillate fraction comprising predominantly rosin acids (e.g., LYTOR® 100) may be blended in a wide range of proportions. In such mixtures, representative amounts of fatty acids and rosin acids range from about 20% to about 99% by weight and from about 1% to about 55% by weight, respectively. Representative weight ratios of the first tall oil distillate fraction to the second tall oil distillate fraction may range from about 3:2 to about 4:1. If such a blend is used to form a maleated tall oil material via reaction with an α,β unsaturated carboxylic acid or anhydride, suitable amounts of the anhydride (or acid(s)) may range from about 2% to about 25% by weight, usually from about 2% to about 15% by weight, based on the combined weight of the tall oil fractions and the anhydride (or acid(s). Depending on the tall oil composition and fractionation conditions, a single tall oil distillate fraction may also suffice to yield a composition that is substantially the same as any of the blends of tall oil distillate fractions discussed above.

In certain embodiments, maleated unsaturated fatty acid compositions suitable for use in making an oxidized and maleated unsaturated fatty acid composition are commercially available. For example, maleated tall oil products can be obtained commercially as XTOL® 690 and XTOL® 692 (from Georgia-Pacific Chemicals LLC, Atlanta, Ga.).

As noted above, the steps of oxidation and maleation of hydrocarbon-based composition can be conducted in either order, as illustrated by the examples which follow.

C. Collector Blends

Compositions for use in the methods described herein can include blends of one or more of the collectors described herein. In some embodiments, the blends can further contain other products suitable for use in a froth flotation cell. In some embodiments, a blend can contain from 1% to 99% of a collector (e.g., 10%, 25%, 30%, 50%, 65%, 80%, 95%, or 99%) and from 1% to 99% of one or more additional components (e.g., 10%, 25%, 30%, 50%, 65%, 80%, 95%, or 99%). In some embodiments, a blend can contain more than one collector. In some embodiments, a blend can be composed of a collector and one or more of a frothing agent, a depressant, an additional collector, an activator, and a modifier, as described above. In some embodiments, a blend contains a collector and a frothing agent. In some embodiments, a blend contains a collector and a depressant. In some embodiments, a blend contains a collector and an activator. In some embodiments, a blend contains a collector and a modifier.

In some embodiments, a blend of an oxidized fatty acid composition and an oxmal composition can be prepared. Such a blend can contain from about 1% to about 99% of an oxidized fatty acid composition and from about 1% to about 99% of an oxmal composition. In some embodiments, a blend contains about 75% of an oxidized fatty acid composition and about 25% of an oxmal composition. In some embodiments, a blend contains about 85% of an oxidized fatty acid composition and about 15% of an oxmal composition.

As described previously, a collector as described herein, e.g., an oxidized fatty acid composition, an oxidized clean fatty acid composition, an oxmal composition, and mixtures thereof, can be blended with various additional components used in the flotation of minerals. A collector and one or more additional components can be readily combined and used under general flotation methods for the flotation of many different mineral species. For example, a composition for use in mineral flotation can include a collector blended with:

(1) an alkylsulphosuccinate to float biotite, calcite, dolomite, magnesite, iron oxides, rutile, and ilmenite;

(2) with an alkyl sulfate to float celestite, gypsum, kainite, anglesite, bauxite, barite, alunite, fluorspar, and anhydrite;

(3) a mono or diphosphoric acid ester to float biotite, iron oxides, fluorspar, and titanium minerals;

(4) an oxidized petroleum product to float alunite;

(5) a non-ionic surfactant, such as an alkoxylated alkylphenol, to float coal, feldspar, apatite, and sulfur;

(6) crude tall oil, crude tall oil distillation fractions, and mixtures thereof to float coal, feldspar, apatite, and sulfur;

(7) alkoxylated alkylphenol formaldehyde condensates to float coal, feldspar, apatite, and sulfur;

(8) a succinic acid ester, succinic acid half ester, and mixtures thereof to float fluorspar and apatite;

(9) an alkenylsuccinic acid, alkenylsuccinate salt, and mixtures thereof to float scheelite;

(10) a sarcoside to float apatite and other phosphate ores;

(11) a vegetable oil, such as rice bran oil, to float apatite and other phosphate ores; and

(12) an alkyl hydroxamate to float oxide, hydroxide, and phosphate minerals like aeschynite, anatase, bindheimite, bixbyite, brookite, chrysoberyl, columbite, corundum, cuprite, euxenite, fergusonite, hausmannite, hematite, ilmenite, perovskite, periclase, polycrase, pseudobrookite, pyrochlore, betafite, microlite, ramsdellite, romanechite, cassiterite, plattnerite, pyrolusite, rutile, stishovite, samarskite, senarmontite, chromite, franklinite, magnesiochromite, magnetite, spinel, taaffeite, tantalite, tapiolite, uraninite, valentinite, zincite, brucite, gibbsite, goethite, limonite, manganite, psilomelane, romeite, stetefeldtite, carnotite, tyuyamunite, meta-autunite, autunite, apatite, phosphuranylite, tobernite, rhabdophane, triphylite, woodhouseite, brazilianite, chirchite, lithiophilite, hinsdalite, svanbergite, arthurite, cacoxenite, tsumebite, variscite, hopeite, meta-ankoleite, scholzite, strengite, whitlockite, xenotime, amblygonite, kidwellite, laueite, meta-uranocircite, meta-variscite, montebrasite, pseudomalachite, rockbridgeite, strunzite, tarbuttite, whiteite, anapaite, augelite, beraunite, chalcosiderite, collinsite, uranocircite, zeunerite, boltwoodite, uranophane, meta-torbernite, meta-uranocircite, walpurgite, zippeite, uranopilite, coconinoite, monazite, Stibiconite, quetzalcoaltlite, zincite, hodgkinsonite, aurichalcite, hydrozincite, rosasite, descloizite, Hopeite, veszelyite, ktenasite, and gahnite An oxidized fatty acid composition, an oxidized clean fatty acid composition, an oxmal composition, and mixtures thereof can also be blended with one or more fatty acids. For example, an oxidized fatty acid composition can be blended with oleic acid.

IV. Kits and Articles of Manufacture

The collector compounds and compositions described herein may be packaged as articles of manufacture (e.g., kits) containing packaging material, a collector compound or composition as provided herein within the packaging material, and a label that indicates that the collector compound or composition, is useful for froth flotation.

Typically, a kit includes a collector as described herein. In some embodiments, a kit includes at least two collectors. In some embodiments, a kit includes an oxidized fatty acid composition. In certain embodiments, a kit can include directions for use of the kit (e.g., instructions for froth flotation). In some embodiments, a kit includes an oxmal composition. In some embodiments, a kit includes one or more oxidized fatty acid compositions and one or more oxmal compositions. In some embodiments, the kit further comprises one or more of a frothing agent, a depressant, an additional collector, an activator, a modifier, and mixtures thereof. In certain embodiments, a kit can include a collector and a frothing agent. In another embodiment, a kit can include a collector and a depressant. In some embodiments, a kit can include a collector and an activator. In some embodiments, a kit can include a collector and a modifier. In some embodiments, a kit includes a blend of a collector and one or more of a frothing agent, a depressant, an additional collector, an activator, a modifier, and mixtures thereof.

In some embodiments, the kit can include a collector and a label that indicates that the contents are to be used in froth flotation. In another embodiment, the kit can include a collector and a label that indicates that the contents are to be used in phosphate froth flotation. In another embodiment, the kit can include a collector and a label that indicates that the contents are to be used in potash froth flotation. In a further embodiment, a kit can include a collector and a label that indicates that the contents are to be used in combination with one or more of a frothing agent, a depressant, an additional collector, an activator, a modifier, and mixtures thereof.

In one embodiment, the present invention is:

1. A method of froth flotation, the method comprising floating a mineral using a collector comprising one or more of an oxidized clean fatty acid composition, an oxmal composition, and mixtures thereof.
2. A method according to paragraph 1, wherein the collector is an anionic collector.

3. A method according to paragraph 2, wherein the anionic collector has a counter cation chosen from $Li^+$, $Na^+$, $K^+$, $NH_4^+$, alkyl ammonium ions, and imidazoline cations.
4. A method according to paragraph 2, wherein the anionic collector has a counter cation chosen from $Li^+$, $Na^+$, and $K^+$.
5. A method according to any of the preceding paragraphs, wherein the collector is an oxidized fatty acid composition.
6. A method according to paragraph 5, wherein the oxidized fatty acid composition is an oxidized tall oil fatty acid composition.
7. A method according to any of the preceding paragraphs, wherein the collector is an oxmal composition.
8. A method according to any of the preceding paragraphs, wherein the mineral is chosen from phosphate, barite, fluorite, feldspar, potash, fluorspar, magnesite, scheelite, celestite, anglesite, alunite, bauxite, gypsum, kainite, biotite, calcite, dolomite, albite, orthoclase, microcline, fluorspar, gypsum, anhydrite, columbite, tantalite, pyrochlore, apatite, cassiterite, wolframite, rutile, ilmenite, hematite, and kaolin.
9. A method according to paragraph 8, wherein the mineral is phosphate.
10. A method according to paragraph 8, wherein the mineral is potash.
11. A method according to any of the preceding paragraphs, wherein the method further comprises use of a frothing agent.
12. A method according to any of the preceding paragraphs, wherein the method further comprises use of a depressant.
13. A method of froth flotation comprising the use of a collector made by the process of:
    a) providing a clean fatty acid composition; and
    b) oxidizing the clean fatty acid composition;
    to separate a mineral from gangue.
14. A method of froth flotation comprising the use of a collector made by the process of:
    a) providing a fatty acid composition;
    b) maleating the fatty acid composition; and
    c) oxidizing the fatty acid composition; to separate a mineral from gangue.
15. A method of phosphate froth flotation comprising the use of a collector made by the process of:
    a) providing a clean fatty acid composition; and
    b) oxidizing the clean fatty acid composition; to separate phosphate from gangue.
16. A method of phosphate froth flotation comprising the use of a collector made by the process of:
    a) providing a fatty acid composition;
    b) maleating the fatty acid composition; and
    c) oxidizing the fatty acid composition; to separate phosphate from gangue.
17. A froth flotation process comprising collecting a mineral using an oxidized fatty acid composition, wherein the oxidized fatty acid composition comprises less than 2.5% by weight of a plant-derived amine.
18. A froth flotation process comprising collecting a mineral using an oxidized fatty acid composition, wherein the oxidized fatty acid composition comprises at least 65% by weight of an oxidized fatty acid.
19. A froth flotation process comprising collecting a mineral using an oxidized fatty acid composition, wherein the oxidized fatty acid composition comprises less than 5% by weight of a tall oil pitch.
20. A froth flotation process comprising collecting a mineral using an oxidized fatty acid composition, wherein the oxidized fatty acid composition comprises less than 20% by weight of a fuel oil or furnace oil.
21. A froth flotation process comprising collecting a mineral using an oxidized fatty acid composition, wherein the oxidized fatty acid composition has an acid value of at least about 80.
22. A froth flotation process according to paragraph 21, wherein the oxidized fatty acid composition has an acid value of at least about 110.
23. A froth flotation process according to paragraph 21, wherein the oxidized fatty acid composition has an acid value of between about 120 and about 150.
24. A froth flotation process comprising collecting a mineral using an oxidized fatty acid composition and providing a yield of the mineral which is higher than a yield of the mineral provided by a fatty acid composition.
25. A froth flotation process comprising collecting a mineral using an oxmal composition and providing a yield of the mineral which is higher than a yield of the mineral provided by a fatty acid composition.
26. A froth flotation process comprising collecting a mineral using an oxidized fatty acid composition and providing a grade of the mineral which is higher than a grade of the mineral provided by a fatty acid composition.
27. A froth flotation process comprising collecting a mineral using an oxmal composition and providing a grade of the mineral which is higher than a grade of the mineral provided by a fatty acid composition.
28. A method of potash froth flotation, the method comprising floating potash using a collector comprising an oxidized fatty acid composition.
29. A method of potash froth flotation, the method comprising floating potash using a collector comprising an oxmal composition.
30. A method of separating a mineral from gangue, the method comprising providing an oxidized fatty acid composition to a solution of the mineral and gangue, thereby separating the mineral from the gangue.
31. A method of separating a mineral from gangue, the method comprising providing an oxmal composition to a solution of the mineral and gangue, thereby separating the mineral from the gangue.
32. A composition comprising a collector and a frothing agent, wherein the collector comprises one or more of an oxidized fatty acid composition, oxmal composition, and mixtures thereof.
33. A composition comprising a collector and a depressant, wherein the collector comprises one or more of an oxidized fatty acid composition, oxmal composition, and mixtures thereof.
34. A composition comprising two or more collectors, wherein at least one, but not all, of the collectors is an oxidized fatty acid.
35. A kit comprising a collector and a frothing agent, wherein the collector comprises one or more of an oxidized fatty acid composition, oxmal composition, and mixtures thereof.
36. A kit comprising a collector and a depressant, wherein the collector comprises one or more of an oxidized fatty acid composition, oxmal composition, and mixtures thereof.
37. A kit according to one of paragraphs 35 and 36, wherein the kit further comprises instructions for floating a mineral.
38. A kit according to one of paragraphs 35 and 36, wherein the kit further comprises a label that indicates that the contents are to be used in froth flotation of a mineral.

EXAMPLES

General Methods

Acid value was determined using standard methods ASTM D 465-05 and AOCS Te 1a-64. Standard test methods ASTM D 803-03 and AOCS Ja 10-87 (93) were used to measure Brookfield viscosity. Gardner-Holdt viscosity was determined using standard methods ASTM D1545-07 and AOCS Ja 11-87 (93). A hydrous acid number was obtained by titrating a sample of product dissolved in solvent (e.g., alcohol) using aqueous 0.5 N NaOH to a potentiometric endpoint (e.g., pH 13). All acid functionalities were titrated completely. The same ASTM test methodology as described above were used.

Example 1

Oxidized and Oxmal Compositions as Flotation Collectors in Phosphate Beneficiation Phosphate ore can be beneficiated using the Crago Double Flotation process, in which the ore is first subjected to flotation using an anionic collector, and then the improved ore is subjected to a second "Reverse Flotation" using a cationic collector that floats clay and allows the improved phosphate ore to sink. This example addresses the first "Positive Flotation" using an anionic collector. The following reagents along with a proprietary commercial reagent were evaluated:

(1) An oxidized TOFA composition;
(2) XTOL® 100 (commercially available TOFA; used commercially as a component of a phosphate collector);
(3) An oxidized and maleated TOFA composition;
(4) A maleated TOFA composition;
(5) A maleated and oxidized Crude Tall Oil composition; and
(6) An oxidized and maleated 70:30 blend of TOFA and rosin.

Performance evaluation of the collectors in phosphate flotation was conducted under the following operating conditions:

The phosphate ore test sample was collected from central Florida. The phosphate sample was homogenized and split for analyses, storage and later usage. The acid insols (A.I.) content and $P_2O_5$ grade of the phosphate was about 71.5% and 14.2%, respectively. The phosphate sample contained about 0.7% by weight particles larger than 16 mesh (1.18 mm). The 30-100 mesh particle size fraction accounted for more than 90% by weight of the same, while the 100-200 mesh fraction accounted for less than 1% by weight.

A Denver D-12 lab flotation machine equipped with a 2-liter tank was used for the phosphate flotation tests. Collector type, collector dosage and conditioning pH's were investigated in this study. The conditioning time and the impeller rotating speed were fixed at 2 minutes and 1500 rpm, respectively.

FIG. 1 shows the effects of collector dosage (ranging from 0.3 lb/ton to 0.9 lb/ton) on the percentage of phosphate flotation recovery was evaluated for each of the six collectors described above along with a typical commercial phosphate collector, labeled plant reagent. The curves indicate that flotation $P_2O_5$ recovery increased significantly as the collector dosage increased from 0.3 lb/ton to 0.9 lb/ton. Collector (1), oxidized TOFA, showed a better percent recovery at all dosages than any of the other test samples including the typical commercial phosphate collector (plant reagent) and straight tall oil fatty acid (2), which has also been used as a commercial phosphate collector. Collector (1) achieved a maximum flotation $P_2O_5$ recovery of 99.7% at a collector dosage of 0.9 lb/ton, while the commercial phosphate collector (plant reagent) when used at a dosage of 0.9 lb/ton achieved a maximum flotation recovery of 97.9%.

Figure 2:
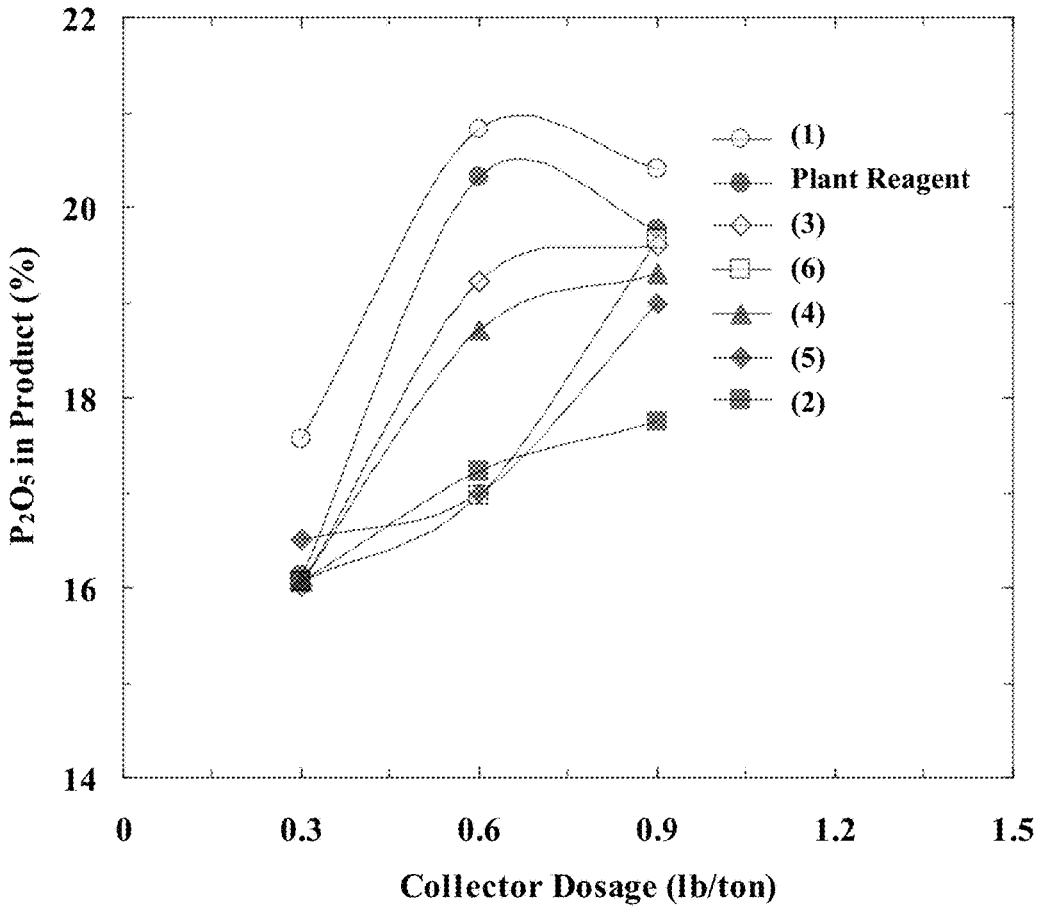
FIG. 2 details the effects of collector type and dosage on phosphate flotation product $P_2O_5$ grade.

FIG. 2 illustrates the effects of collector dosage on percent $P_2O_5$ recovery in the product for each of the experimental collectors including a typical commercial phosphate collector, labeled plant reagent. The curves indicate that percent $P_2O_5$ in product reached a maximum for all reagents at 0.6 lb/ton. As with percent recovery, Collector (1), oxidized TOFA, yielded the highest percent $P_2O_5$ in the product at all dosages compared to the other test collectors. Collector (1) achieved a concentrate of 20.4% $P_2O_5$ at a collector dosage of 0.9 lb/ton. Comparatively, the commercial phosphate collector (plant reagent) when used at a dosage of 0.9 lb/ton achieved a concentrate grade of 19.8% $P_2O_5$.

Figure 3:
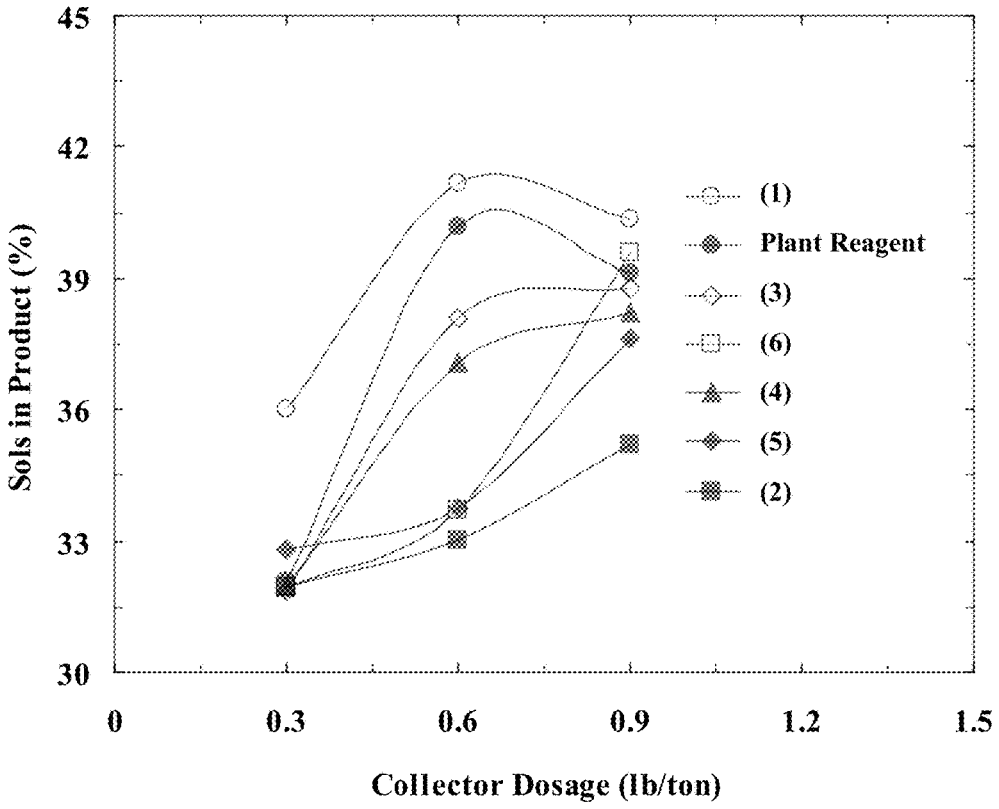
FIG. 3 shows the effects of collector type and dosage on the sols grade of flotation product.

FIG. 3 shows the effects of collector dosage on percent sols (acid solubles) in the product for each of the collectors. Percent sols in product is a measure of the amount of available phosphorus in the product. The curves indicate that percent $P_2O_5$ in product reached a maximum for most reagents at 0.6 lb/ton. As with percent recovery and percent $P_2O_5$ in product, Collector (1), oxidized TOFA, exhibited the highest percent sols in product at all dosages. Collector (3), an oxmal composition, showed strong performance as well especially compared to straight tall oil fatty acid (2). Collector (1) achieved a percent sols in product of 40.4% compared to 39.1% for the commercial phosphate collector (plant reagent) when used at a dosage of 0.9 lb/ton.

Figure 4:
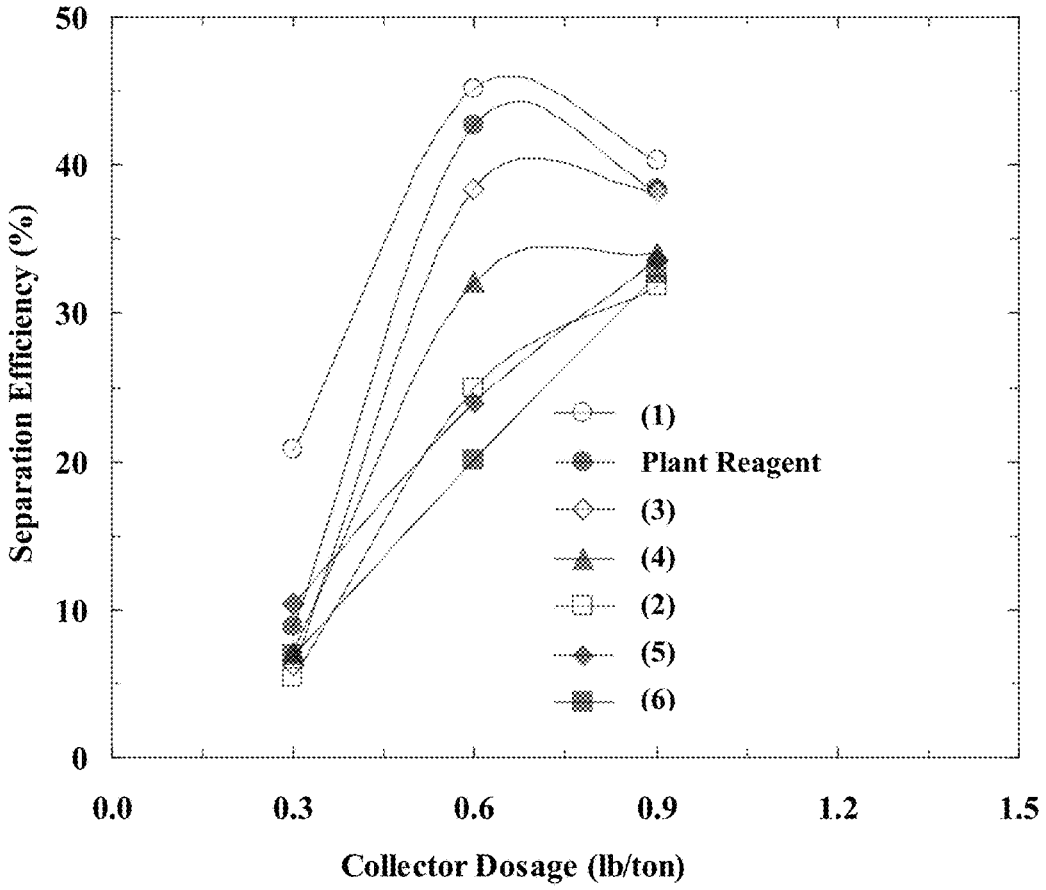
FIG. 4 illustrates the effects of collector type and dosage on phosphate separation efficiency.

FIG. 4 shows the effects of collector type and dosage on phosphate separation efficiency, which is defined as the difference between $P_2O_5$ recovery and A.I. recovery, i.e., separation efficiency =(% $P_2O_5$ recovery+% A.I. rejection=100%). The curves indicate that separation efficiency increased as the collector dosage increased from 0.3lb/ton to 0.6 lb/ton. The maximum separation efficiency with (1), plant reagent, and (3) was achieved at the collector dosages of about 0.6 lb/ton. At higher concentrations of collector the separation efficiency decreased due to a decrease in A.I. rejection. The separation efficiency with (1) was superior to all other collectors evaluated. As in the percent sols evaluation, Collector (3) outperformed Collector (2) XTOL® 100 in separation efficiency.

Figure 5:
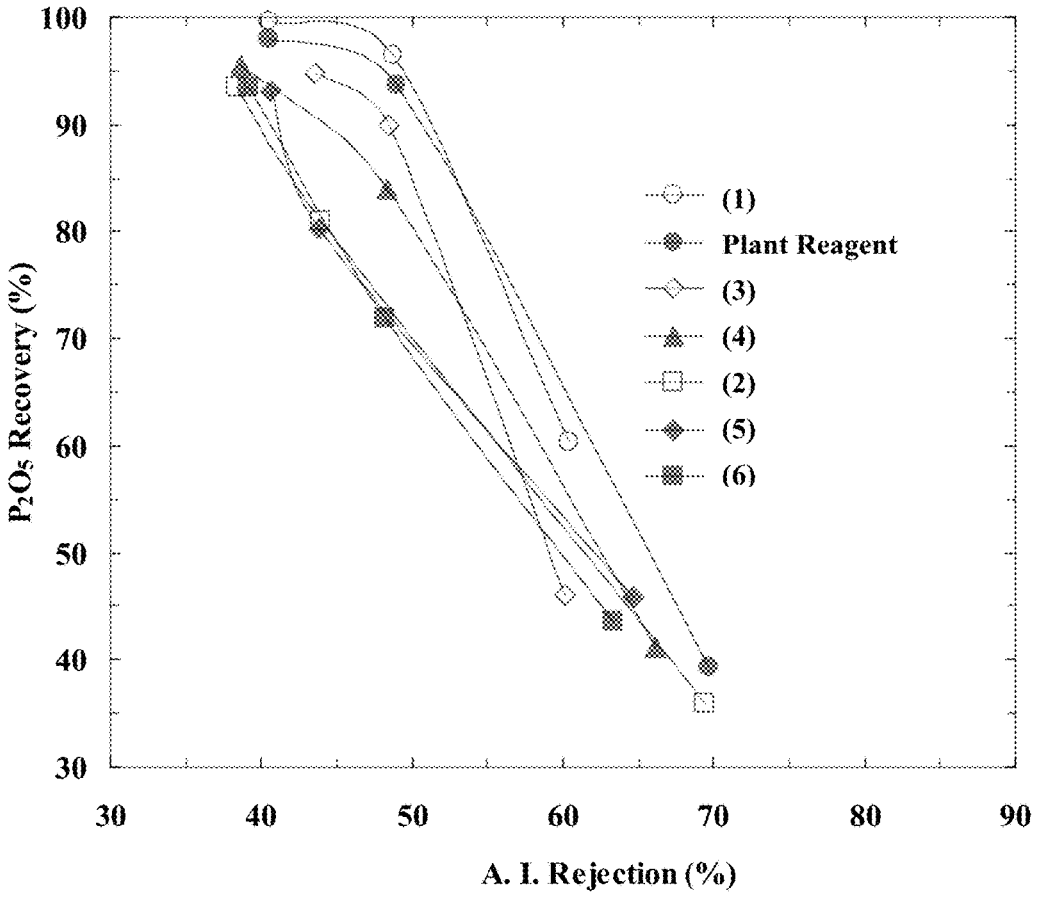
FIG. 5 details $P_2O_5$ recovery vs. A.I. rejection.

FIG. 5 illustrates the relationship between $P_2O_5$ recovery and A.I. rejection for the seven collectors. The curves indicate that flotation $P_2O_5$ recovery with Collector (1) was about 2% higher at a given A.I. rejection value compared to the plant reagent in the high $P_2O_5$ recovery range. The fact that the Collector (1) curve was always above the plant reagent curve and, in fact, all other curves suggests that Collector (1) exhibited the highest separation efficiency.

In summary, the results shown in FIG. 1 to FIG. 5 indicate that Collector (1) performed the best of the seven collectors for the phosphate flotation under the conditions tested. In addition, Collector (3) exhibited superior phosphate flotation abilities compared to Collector (2) (XTOL® 100) in every test.

Example 2

Preparation of Oxidized Tall Oil Fatty Acid

To a 2 liter flask fitted with a thermocouple, a fitted-glass sparge tube, a condenser, and a stirrer blade was added 1400.0 grams (4.87 moles) of tall oil fatty acid. The reaction flask was then heated to 165° C. Once the tall oil fatty acid reached a temperature of 155° C., an air sparge was applied to the reaction vessel at a rate of 4 liters/minute. Once the temperature reached 165° C., the reaction mixture was held at that temperature for 38 hours until the acid value was 120-140 mg KOH/g. The air sparge was then removed and the oxidized tall oil fatty acid was cooled to 60° C. and poured into a sample container. The physical properties for this product are as follows: Acid Value (mg KOH/g)=137.1; Brookfield Viscosity=3604 cPs (25° C., S#18, 100 rpm); Density (25° C.)=8.18 lbs/gal; Sp. Gray. (25° C.)=0.982.

Example 3

Oxidation of Maleated Tall Oil Products

Two maleated tall oil products, XTOL® 690 and XTOL® 692, were oxidized using air at an elevated temperature. XTOL® 690 is a tall oil blend of tall oil fatty acid bottoms and a distilled tall oil, which blend has been maleated at a level of about 3.5%. XTOL° 692 is a blend of a tall oil rosin and tall oil fatty acid, which blend has been maleated at a level of about 12%.

Each of these tall oil blends was charged into a reactor which was fitted with an agitator, a thermocouple and a fritted glass sparge stone attached by a hose to an air supply. The tall oil blends were heated to 165° C. and the air turned on and adjusted to a flow rate of 4 L/hr through the sparge stone. The maleated tall oil reaction mixture was then heated to 177° C. and sampled frequently for acid value and viscosity (Gardner-Holdt) as the oxidation reactions proceeded, while holding the reaction mixture at a temperature of 177° C. The reaction mixture was held at a temperature of 177° C. for 10.5-16 hours as air was sparged. The reaction mixture was then cooled to 70-85° C. and discharged. The final physical properties of the maleated and oxidized tall oil product were determined as described above. The properties of the maleated and oxidized tall oil products were measured as shown in the following table with reference to typical properties of the starting materials:

| | XTOL ® 690 | Oxidized XTOL ® 690 | XTOL ® 692 | Oxidized XTOL ® 692 |
|---|---|---|---|---|
| Acid Value (mg KOH/g) | 197.3 | 158.7 | 276.0 | 203.9 |
| Brookfield Viscosity (cPs; 25° C.) | 484.9 | 8496 | 1451 | 18010 |
| Density (Lbs./gal) | 8.00 | 8.38 | 8.41 | 8.59 |
| Sp. Gravity (25° C.) | 0.961 | 1.006 | 1.010 | 1.031 |

| | | Visc | GPC Results | | | | | |
|---|---|---|---|---|---|---|---|---|
| | | (cPs; | UV Detector | | | RI Detector | | |
| Description | AcV | 25° C.) | Mn | Mw | Mz | Mn | Mw | Mz |
| Oxidized XTOL ® 692 | 210.4 | 13560 | 654 | 1421 | 2884 | 519 | 844 | 1900 |
| Oxidized XTOL ® 690 | 158.7 | 8970 | 800 | 3410 | 9378 | 618 | 1959 | 7330 |

Example 4

Maleation of Oxidized Tall Oil

An oxidized and maleated tall oil composition was produced through the maleation of a commercially available oxidized tall oil product. The oxidized tall oil product, XTOL® MTO, which is an oxidized, high acid value crude tall oil, available commercially from Georgia Pacific was used as the starting material. This oxidized crude tall oil was treated with maleic anhydride.

XTOL® MTO (95 wt %) was charged to a sealed reactor fitted with an agitator, a thermocouple and a condenser. The reactor was heated to 180° C. At 180° C. maleic anhydride (5 wt %) was added slowly to the reactor. The reaction mixture was then heated to 200° C. for approximately 3-6 hours or until all of the maleic anhydride had reacted. The reaction mixture was then cooled to 70-80° C. and discharged. The final physical properties were determined as described above. The properties of the oxidized and maleated tall oil product were measured as shown in the following table with reference to typical properties of the starting materials:

| | XTOL ® MTO | Maleated XTOL ® MTO (Oxidized tall oil) |
|---|---|---|
| Acid Value | 143.0 | 163.8 |
| Density (25° C.; Lbs./gal) | 8.25 | 8.52 |
| Sp. Gravity (25° C.) | 0.99 | 1.023 |
| Brookfield Viscosity (cPs: 25° C.) | 4870 | 22580 |

Example 5

Maleation of Crude Tall Oil followed by Oxidation

A process similar to the one described in Example 1 was used, whereby a crude tall oil mixture was maleated followed by oxidation. In this specific example, the composition was maleated to a level of about 5% and then oxidized.

A crude tall oil (95 wt. %) was charged to a sealed reactor fitted with an agitator, a thermocouple, and a condenser. The reaction mixture was heated to 180° C. At 180° C., maleic anhydride (5 wt. %) was added slowly to the reactor. The reaction mixture was then heated to 200° C. for approximately 3-6 hours or until all of the maleic anhydride had reacted. Once all of the maleic anhydride had reacted, the reaction mixture was then cooled to 180° C. and air was introduced to the reaction mixture using a fitted glass sparge stone attached by a hose to an air supply. The air was turned on and adjusted to a flow rate of 4 L/hr through the sparge stone. Oxidation of the maleated crude tall oil with air was carried out for 12-16 hours. The reaction mixture was then cooled to 70-85° C. and discharged. The final physical properties were determined. The properties of the maleated and oxidized tall oil product were measured as shown in the following table with reference to typical properties of the starting materials:

| | Crude Tall Oil | Maleated-Oxidized Crude tall oil |
|---|---|---|
| Acid Value | 161.6 | 169.5 |
| Density (25° C.; Lbs/gal) | 8.088 | 8.54 |

-continued

| | Crude Tall Oil | Maleated-Oxidized Crude tall oil |
|---|---|---|
| Specific Gravity (25° C.) | 0.9706 | 1.027 |
| Brookfield Viscosity (cPs; 25° C.) | 695.0 | 33800 |

Example 6

Oxidation of Maleated Tall Oil Fatty Acid

In this example, a maleated tall oil fatty acid (TOFA) was oxidized using air at an elevated temperature.

TOFA was charged to a sealed reactor and the contents of the reactor were heated to 70° C. Once a temperature of 70° C. was achieved, maleic anhydride in an amount of about 25% by weight of the overall reaction was added to the vessel. The reactor mixture was then heated to 220° C. in several stages. From the starting temperature of 70° C., the temperature was increased in small increments until 220° C. was achieved. After each temperature adjustment and the desired set point was reached, the material was maintained at the set point temperature for a five minute hold period. The first stage of heating was from 70° C. to 130° C.; the second stage of heating was from 130° C. to 160° C.; the third stage of heating was from 160° C. to 185° C.; the fourth stage of heating was from 185° C. to 205° C.; and the fifth and final stage of heating was from 205° C. to 220° C. The reaction mixture then was held at 220° C. until a Gardner-Holdt viscosity of about Z-2 was reached. This holding period typically required about 5 hours depending on the batch size. The reaction mixture was cooled to a discharge temperature and the physical properties of the maleated product were measured as described above. Typically, the maleated product exhibited an acid number (hydrous) equal to 300-320 mg KOH/g, a specific gravity of 1.04 and a Brookfield Viscosity (at 25° C.) equal to 2700-3400 cps.

To produce a maleated and oxidized fatty acid composition, the maleated tall oil fatty acid was then charged to a reactor which was fitted with an agitator, a thermocouple, and a fitted glass sparge stone attached by a hose to an air supply. The maleated tall oil fatty acid was heated to 165° C. and the air was turned on and adjusted to a flow rate of 4 L/hr through the sparge stone. The reaction mixture was then heated to 177° C. and sampled frequently for acid value and viscosity (Gardner-Holdt) while holding the reaction mixture at 177° C. The reaction mixture was held at 177° C. for 10.5-16 hours as air was sparged. The reaction mixture was then cooled to 70-85° C. and discharged. The final physical properties of the maleated and oxidized TOFA were then determined as described above. The properties of the maleated and oxidized TOFA were measured as:

| | Oxidized Maleated Tall Oil Fatty Acid |
|---|---|
| Acid Value | 250 |
| Density (25° C.; Lbs./gal) | 8.80 |
| Specific Gravity (25° C.) | 1.056 |
| Brookfield Viscosity (cPs; 25° C.) | 17530 |

| | | Visc | GPC Results | | | | | |
|---|---|---|---|---|---|---|---|---|
| | | (cPs; | UV Detector | | | RI Detector | | |
| Description | AcV | 25 C.) | Mn | Mw | Mz | Mn | Mw | Mz |
| Oxidized Maleated TOFA | 258.5 | 13560 | 830 | 1503 | 2678 | 654 | 908 | 1603 |
| Oxidized Maleated TOFA | 247.3 | 19328 | 841 | 1535 | 2759 | 644 | 879 | 1548 |

Example 7

Oxidation of Maleated Arachidonic Acid (ARA)

In this example, a maleated arachidonic acid (ARA) is oxidized using air at an elevated temperature. Arachidonic acid is produced by the saponification of natural fish oils and is particularly prevalent in sardine oil.

ARA is charged to a sealed reactor and the contents of the reactor are heated to 70° C. Once a temperature of 70° C. is achieved, maleic anhydride in an amount of about 40% by weight of the total reaction is added to the vessel. The reactor mixture is then heated to 220° C. in several stages. From the starting temperature of 70° C., the temperature is increased in small increments until 220° C. is achieved. After each temperature adjustment and the desired set point is reached, the material is maintained at the set point temperature for a five minute hold period. The first stage of heating is from 70° C. to 130° C.; the second stage of heating is from 130° C. to 160° C.; the third stage of heating is from 160° C. to 185° C.; the fourth stage of heating is from 185° C. to 205° C.; and the fifth and final stage of heating is from 205° C. to 220° C. The reaction mixture then is held at 220° C. until a Gardner-Holdt viscosity of about Z-2 is reached. This holding period varies depending on the batch size. The reaction mixture is cooled to a discharge temperature and the physical properties of the maleated product are measured as described in previous examples.

To produce a maleated and oxidized ARA composition, the maleated ARA is then charged to a reactor which is fitted with an agitator, a thermocouple, and a fitted glass sparge stone attached by a hose to an air supply. The maleated ARA is heated to 165° C. and the air is turned on and adjusted to a flow rate of 4 L/hr through the sparge stone. The reaction mixture is then heated to 177° C. and sampled frequently for the acid value and viscosity (Gardner-Holdt) that is appropriate for the specific application while holding the reaction mixture at 177° C. The reaction mixture is held at 177° C. for the length of time necessary to achieve the desired acid value and viscosity as air is sparged. The reaction mixture is then cooled to 70-85° C. and discharged.

A non-limiting example of a compound produced by the above procedure is:

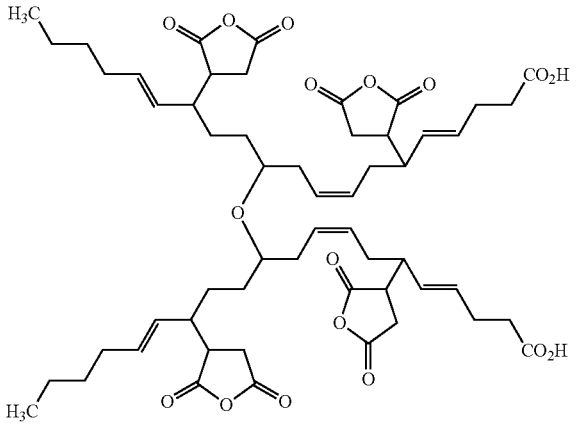

Example 8

Production of a Na Salt of an Oxidized Tall Oil Fatty Acid

A 250-mL stainless steel beaker was placed in a sand bath which was capable of heating. To the 250-mL stainless steel beaker was added 100.49 g (0.245 moles) of an oxidized tall oil fatty acid. A mechanical stirrer and a thermocouple were placed in the beaker. The oxidized tall oil fatty acid was slowly heated to 60° C. while stirring vigorously. Once the temperature in the beaker reached 60° C., 20.34 g (0.249 moles) of 48.9% NaOH solution was added dropwise over a twenty minute period. During the NaOH addition, an exotherm was experienced in the reaction mixture which increased the temperature to 80° C. Once the addition of the NaOH was complete, 106.14 grams of deionized water was added slowly with vigorous stirring to dilute the reaction mixture to 48.60% solids. The final pH of the solution was 9.43.

Example 9

Production of a Na Salt of an Oxmal Composition

A 250-mL stainless steel beaker was placed in a sand bath which was capable of heating. To the 250-mL stainless steel beaker was added 100.14 g (0.353 moles) of an oxmal composition. A mechanical stirrer and a thermocouple were placed in the beaker. The oxmal composition was slowly heated to 60° C. while stirring vigorously. Once the temperature in the beaker reached 60° C., 28.87 g (0.353 moles) of 48.9% NaOH solution was added, dropwise, over a twenty minute period. During the NaOH addition, an exotherm was experienced in the reaction mixture which increased the temperature to 90° C. Once the addition of the NaOH was complete, 99.68 grams of deionized water was added slowly with vigorous stirring to dilute the reaction mixture to 49.96% solids. The final pH of the solution was 9.00.

A number of embodiments have been described. Nevertheless, it will be understood that various modifications may be made without departing from the spirit and scope of the disclosure. Accordingly, other embodiments are within the scope of the following claims.

What is claimed is:

1. A composition comprising at least one collector and at least one of a frothing agent and a depressant, wherein the collector comprises an oxidized fatty acid composition, an oxidized and maleated fatty acid composition, or a mixture thereof, wherein the oxidized fatty acid composition comprises one or more compounds or salts thereof having at least two $C_{10}$-$C_{24}$ structures crosslinked by an ether linkage and has an acid value of about 50 mg KOH/g of the oxidized fatty acid to about 400 mg KOH/g of the oxidized fatty acid, wherein the oxidized and maleated fatty acid composition comprises one or more compounds or salts thereof having at least two $C_{10}$-$C_{24}$ structures crosslinked by an ether linkage, and wherein at least one of the $C_{10}$-$C_{24}$ structures in the oxidized and maleated fatty acid composition is substituted by at least one $\alpha,\beta$ unsaturated carboxylic acid or anhydride moiety.

2. The composition of claim 1, wherein the oxidized fatty acid composition is present.

3. The composition of claim 1, wherein the oxidized fatty acid composition is present and has an acid value of about 50 mg of KOH/g of the oxidized fatty acid composition to about 200 mg of KOH/g of the oxidized fatty acid composition.

4. The composition of claim 1, wherein the oxidized fatty acid composition is present and has an acid value of at least 110 mg of KOH/g of the oxidized fatty acid composition to about 200 mg of KOH/g of the oxidized fatty acid composition.

5. The composition of claim 1, wherein the frothing agent is present and is selected from the group consisting of: pine oil, methyl isobutyl carbinol, glycols, polyglycols, glycol ethers of aliphatic alcohols, and polyglycol ethers of aliphatic alcohols.

6. The composition of claim 1, wherein the depressant is present and is selected from the group consisting of: cyanide salts, sodium sulphide, sodium hydrosulphide, sulphites, waterglass, polysaccharides, chemically modified polysaccharides, natural gums, and chemically modified natural gums.

7. The composition of claim 1, wherein the oxidized fatty acid composition, the oxidized and maleated fatty acid composition, or the mixture thereof comprises tall oil fatty acids.

8. The composition of claim 1, wherein the oxidized fatty acid composition, the oxidized and maleated fatty acid composition, or the mixture thereof comprises fatty acids that do not contain one or more of a tall oil pitch, an amine, or sarcosine.

9. The composition of claim 1, wherein the frothing agent is selected from the group consisting of: pine oil, methyl isobutyl carbinol, glycols, polyglycols, glycol ethers of aliphatic alcohols, and polyglycol ethers of aliphatic alcohols, and wherein the depressant is selected from the group consisting of: cyanide salts, sodium sulphide, sodium hydrosulphide, sulphites, waterglass, polysaccharides, chemically modified polysaccharides, natural gums, and chemically modified natural gums.

10. A kit comprising a collector and at least one of a frothing agent and a depressant, wherein the collector comprises an oxidized fatty acid composition, an oxidized and maleated fatty acid composition, or a mixture thereof, wherein the oxidized fatty acid composition comprises one or more compounds or salts thereof having at least two $C_{10}$-$C_{24}$ structures crosslinked by an ether linkage and has an acid value of about 50 mg KOH/g of the oxidized fatty acid to about 400 mg KOH/g of the oxidized fatty acid, wherein the oxidized and maleated fatty acid composition comprises one or more compounds or salts thereof having at least two $C_{10}$-$C_{24}$ structures crosslinked by an ether linkage, and wherein at least one of the $C_{10}$-$C_{24}$ structures in the oxidized and maleated fatty acid composition is substituted by at least one α, β unsaturated carboxylic acid or anhydride moiety.

11. The kit of claim 10, further comprising instructions for floating a mineral, and a label that indicates that contents of the kit are to be used in froth flotation of a mineral.

12. A composition comprising at least one collector and at least one of a frothing agent and a depressant, wherein the collector comprises an oxidized and maleated fatty acid composition having an acid value of about 50 mg of KOH/g of the oxidized and maleated fatty acid composition to about 400 mg of KOH/g of the oxidized and maleated fatty acid composition.

13. The composition of claim 12, wherein the frothing agent is selected from the group consisting of: pine oil, methyl isobutyl carbinol, glycols, polyglycols, glycol ethers of aliphatic alcohols, and polyglycol ethers of aliphatic alcohols, and wherein the depressant is selected from the group consisting of: cyanide salts, sodium sulphide, sodium hydrosulphide, sulphites, waterglass, polysaccharides, chemically modified polysaccharides, natural gums, and chemically modified natural gums.

14. A composition comprising at least one collector and at least one of a frothing agent and a depressant, wherein the collector comprises one or more compounds or salts thereof having at least two $C_{10}$-$C_{24}$ structures crosslinked by an ether linkage, and wherein at least one of the $C_{10}$-$C_{24}$ structures is substituted by at least one α, βunsaturated carboxylic acid or anhydride moiety.

15. The composition of claim 14, wherein the at least two $C_{10}$-$C_{24}$ structures comprise tall oil fatty acids.

16. The composition of claim 14, wherein the at least two $C_{10}$-$C_{24}$ structures comprise fatty acids that do not contain one or more of a tall oil pitch, an amine, or sarcosine.

17. The composition of claim 14, wherein the frothing agent is selected from the group consisting of: pine oil, methyl isobutyl carbinol, glycols, polyglycols, glycol ethers of aliphatic alcohols, and polyglycol ethers of aliphatic alcohols, and wherein the depressant is selected from the group consisting of: cyanide salts, sodium sulphide, sodium hydrosulphide, sulphites, waterglass, polysaccharides, chemically modified polysaccharides, natural gums, and chemically modified natural gums.

18. The composition of claim 14, further comprising water and an ore, wherein the ore comprises phosphate, barite, fluorite, feldspar, potash, fluorspar, magnesite, scheelite, celestite, anglesite, alunite, bauxite, gypsum, kainite, biotite, calcite, dolomite, albite, orthoclase, microcline, fluorspar, gypsum, anhydrite, columbite, tantalite, pyrochlore, apatite, cassiterite, wolframite, rutile, ilmenite, hematite, or kaolin.

19. The composition of claim 14, wherein the at least two $C_{10}$-$C_{24}$ structures comprise tall oils, animal oils, plant oils, microbially derived oils, or any mixture thereof.

20. The composition of claim 14, wherein the collector has an acid value of at least 110 mg of KOH/g of the collector to about 200 mg of KOH/g of the collector.

* * * * *